US008915229B2

(12) United States Patent
Kajita et al.

(10) Patent No.: US 8,915,229 B2
(45) Date of Patent: Dec. 23, 2014

(54) ENGINE

(75) Inventors: Daisuke Kajita, Osaka (JP); Tomoaki Kitagawa, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 589 days.

(21) Appl. No.: 13/138,922

(22) PCT Filed: Apr. 20, 2010

(86) PCT No.: PCT/JP2010/056996

§ 371 (c)(1),
(2), (4) Date: Oct. 25, 2011

(87) PCT Pub. No.: WO2010/125948

PCT Pub. Date: Nov. 4, 2010

(65) Prior Publication Data

US 2012/0037121 A1 Feb. 16, 2012

(30) Foreign Application Priority Data

Apr. 30, 2009 (JP) ..... 2009-110625
Apr. 30, 2009 (JP) ..... 2009-110626

(51) Int. Cl.

| | |
|---|---|
| ***F02F 7/00*** | (2006.01) |
| ***F02M 51/00*** | (2006.01) |
| ***F02F 1/24*** | (2006.01) |
| *F02M 55/02* | (2006.01) |

(52) U.S. Cl.

CPC ..... *F02M 51/005* (2013.01); *F02F 7/006* (2013.01); *F02F 7/0095* (2013.01); *F02F 1/24* (2013.01); *F02M 55/02* (2013.01)

USPC ..... 123/195 C; 123/468

(58) Field of Classification Search

CPC ..... F02F 7/00; F02F 7/0046; F02F 7/006; F02F 7/0065; F02F 7/0073; F02F 7/0082; F02F 7/0095; F02M 55/00; F02M 55/02; F02M 2200/24

USPC ..... 123/90.38, 195 C, 468, 469, 470, 478, 123/612

See application file for complete search history.

(56) References Cited

U.S. PATENT DOCUMENTS 3,194,221 A * 7/1965 Dinger et al. ..... 123/193.5
3,402,703 A * 9/1968 Dickerson et al. ..... 123/469

(Continued)

FOREIGN PATENT DOCUMENTS

CN 201050415 4/2008
JP 60-224973 11/1985

(Continued)

*Primary Examiner* — Thomas Moulis
(74) *Attorney, Agent, or Firm* — Jordan and Hamburg LLP

(57) ABSTRACT

An engine includes a head cover covering an upper part of a cylinder head to accommodate a valve gear mechanism and an injector. The head cover is separatable into a lower cover body and an upper cover body detachable from and attachable to the lower cover body. The lower cover body includes a fuel pipe and a relay connector. Through the fuel pipe, fuel is supplied to the injector. The fuel pipe penetrates through the lower cover body. The relay connector is configured to relay power supply from outside the head cover. The relay connector is attached to the lower cover body. One end side of an injector harness disposed in the head cover is coupled to a terminal portion of the injector. Another end side of the injector harness is coupled to the relay connector.

9 Claims, 19 Drawing Sheets

(56) References Cited

U.S. PATENT DOCUMENTS

| | | | | |
|---|---|---|---|---|
| 3,489,435 | A * | 1/1970 | Olson et al. | 285/13 |
| 4,384,557 | A * | 5/1983 | Johnson | 123/198 D |
| 4,922,880 | A * | 5/1990 | Seibt et al. | 123/509 |
| 5,035,637 | A * | 7/1991 | Mathews et al. | 439/271 |
| 5,390,648 | A * | 2/1995 | Yanase | 123/634 |
| 5,511,520 | A * | 4/1996 | Regueiro | 123/193.5 |
| 5,642,704 | A * | 7/1997 | Gogots et al. | 123/198 R |
| 5,697,344 | A * | 12/1997 | Ikari | 123/468 |
| 5,771,850 | A * | 6/1998 | Okada | 123/143 C |
| 5,878,719 | A * | 3/1999 | Nakagomi | 123/470 |
| 6,167,855 | B1 * | 1/2001 | Mammarella et al. | 123/90.38 |
| 6,240,903 | B1 * | 6/2001 | Kurozumi | 123/472 |
| 6,247,681 | B1 | 6/2001 | Gerhardy | |
| 6,382,158 | B1 * | 5/2002 | Durnen | 123/90.38 |
| 6,394,071 | B2 * | 5/2002 | Nitta et al. | 123/456 |
| 6,435,518 | B1 * | 8/2002 | Choi | 277/602 |
| 6,584,949 | B1 * | 7/2003 | Franchi et al. | 123/195 A |
| 6,591,930 | B2 * | 7/2003 | Coughlin et al. | 180/219 |
| 6,609,487 | B1 * | 8/2003 | Morris | 123/90.38 |
| 6,672,272 | B2 * | 1/2004 | McGloin | 123/195 C |
| 6,871,639 | B2 * | 3/2005 | Seymour, II | 123/476 |
| D543,998 | S * | 6/2007 | Platt | D15/5 |
| 7,343,890 | B1 * | 3/2008 | Platt | 123/90.38 |
| 2005/0076886 | A1 | 4/2005 | Shioiri et al. | |

FOREIGN PATENT DOCUMENTS

| | | |
|---|---|---|
| JP | 6-58102 | 8/1994 |
| JP | 8-284745 | 10/1996 |
| JP | 2000-274256 | 10/2000 |
| JP | 2001-132577 | 5/2001 |
| JP | 2002-221083 | 8/2002 |
| JP | 2004-044440 | 2/2004 |
| JP | 2008-008265 | 1/2008 |
| JP | 2009-197742 | 9/2009 |

* cited by examiner

ENGINE

BACKGROUND OF THE INVENTION

Technical Field

The present invention relates to an engine having a head cover covering the upper part of a cylinder head, thus accommodating a valve gear mechanism and an injector.

A conventionally known example of this type of head cover structure is vertically separatable considering maintenance of an injector and other elements disposed in the head cover (see, for example, patent document 1). For example, a head cover structure described in patent document 1 includes an upper cover body and a lower cover body. The upper cover body has a semispherical penetration groove on a lower part of the side wall of the upper cover body. The lower cover body has also a semispherical penetration groove on an upper part of the side wall of the lower cover body. The grooves define a circular form when the upper cover body is superimposed on the lower cover body. An injector harness has one end coupled to the terminal portion of the injector and the other end vertically secured between the semispherical penetration grooves of the cover bodies. Thus, the upper cover body is bolt-jointed to the lower cover body.

Patent document 2 describes a head cover structure including a head cover in the form of a downward opening lid. A semispherical penetration groove is formed on a lower part of the side wall of the head cover. A semispherical penetration groove is also formed on an upper part of the side wall of a cylinder head. The grooves define a circular form when the cylinder head covers the head cover. The semispherical penetration grooves of the head cover and the cylinder head vertically secure an intermediate portion of a fuel pipe that feeds fuel into the injector. Thus, the head cover is bolt-jointed to the cylinder head.

That is, both patent documents 1 and 2 disclose that a member necessary to be wired or piped into the interior or the head cover is vertically secured between the cover bodies or between the head cover and the cylinder head.

RELATED ART DOCUMENTS

Patent Documents

Patent document 1: Japanese Unexamined Patent Application No. 2000-274256.

Patent document 2: Japanese Unexamined Patent Application No. 2001-132577.

SUMMARY OF THE INVENTION

Unfortunately, in both patent documents 1 and 2, semispherical penetration grooves are formed at the connection between the upper and lower cover bodies, or between the head cover and the cylinder head. This raises a question as to sealability of the semispherical penetration grooves. In particular, the bolt-jointing of the upper cover body or the head cover after maintenance requires the semispherical penetration grooves to be securely fitted with a sealing gasket covering the injector harness or the fuel pipe. Thus, there has been room for improvement in workability.

In view of the above-described circumstances, it is a technical object of the invention to provide an improved engine head cover structure.

Means of Solving the Problems

In the present invention, an engine includes a head cover covering an upper part of a cylinder head to accommodate a valve gear mechanism and an injector. The head cover is separatable into a lower cover body and an upper cover body detachable from and attachable to the lower cover body. The lower cover body includes a fuel pipe and a relay connector. Through the fuel pipe, fuel is supplied to the injector. The fuel pipe penetrates through the lower cover body. The relay connector is configured to relay power supply from outside the head cover. The relay connector is attached to the lower cover body. One end side of an injector harness disposed in the head cover is coupled to a terminal portion of the injector. Another end side of the injector harness is coupled to the relay connector.

The lower cover body may have an upper peripheral portion positioned at a height that is same as or lower than a top of a valve arm or a valve bridge constituting the valve gear mechanism.

The engine may further include a harness guide in the head cover. The harness guide may extend in a direction of a crankshaft of the engine and be disposed above the valve gear mechanism. The injector harness may have an intermediate portion mounted and secured on the harness guide.

The engine may further include crank angle detecting means and rotation angle detecting means. The crank angle detecting means is for detecting a crank angle of a crankshaft. The rotation angle detecting means is for detecting a rotation angle of a rotation shaft configured to rotate in conjunction with the crankshaft. The engine may be configured to carry out fuel injection and ignition on an individual cylinder basis based on detection information from the crank angle detecting means and the rotation angle detecting means. The rotation shaft may include a pump shaft at a fuel supply pump disposed adjacent to a suction manifold. A pump shaft pulser is disposed on the pump shaft. The rotation angle detecting means is disposed on a peripheral side of the pump shaft pulser.

In the engine a gear case may be disposed at one side portion of a cylinder block. The gear case may accommodate a crank gear on the crankshaft, a pump gear on the pump shaft, and an idle gear engaged with the crank gear and the pump gear. The pump shaft pulser may be integrally rotatably mounted on the pump gear in the gear case.

In the engine the gear case may include an insertion portion in which the rotation angle detecting means is mounted to oppose to the pump shaft pulser.

In the engine a flywheel rotating integrally with the crankshaft may be disposed at another side portion of the cylinder block. A crankshaft pulser corresponding to the crank angle detecting means and a starter ring gear may be engaged and secured to a peripheral side of the flywheel from mutually opposite sides along a thickness direction of the flywheel.

According to the present invention, an engine includes a head cover covering an upper part of a cylinder head to accommodate a valve gear mechanism and an injector. The head cover is separatable into a lower cover body and an upper cover body detachable from and attachable to the lower cover body. The lower cover body includes a fuel pipe and a relay connector. Through the fuel pipe, fuel is supplied to the injector. The fuel pipe penetrates through the lower cover body. The relay connector is configured to relay power supply from outside the head cover. The relay connector is attached to the lower cover body. One end side of an injector harness disposed in the head cover is coupled to a terminal portion of the injector. Another end side of the injector harness is coupled to the relay connector. This ensures detachment and attachment of the upper cover body without removing the injector harness and the relay connector, as well as the fuel pipe. This provides the advantageous effect of significantly improved workability associated with the opening and closing operation of the head cover and with the maintenance operation of the interior of the head cover. Additionally, the sealing conditions of the portions through which the fuel pipe and the relay connector penetrate remain unchanged even though the upper cover body is detached and attached. This results in an advantageously simple sealing structure necessary to ensure sealability (air tightness and oil tightness) of the head cover.

According to the present invention, the lower cover body has an upper peripheral portion positioned at a height that is same as or lower than a top of a valve arm or a valve bridge constituting the valve gear mechanism. This ensures that removing the upper cover body to open the upper portion of the head cover exposes the valve arm and the valve bridge in an easily touchable (easily adjustable) state. This provides the advantageous effect of facilitated maintenance such as clearance adjustment of the valve arm and the valve bridge, and thus provides the advantageous effect of further improved maintenance performance of the interior of the head cover.

According to the present invention, the engine further includes a harness guide in the head cover. The harness guide extends in a direction of a crankshaft of the engine and is disposed above the valve gear mechanism. The injector harness has an intermediate portion mounted and secured on the harness guide. Due to the existence of the harness guide, the wiring pathway of the injector harness is easily recognizable. This provides the advantageous effect of improving workability of assembly of the injector harness. Additionally, since the injector harness is disposed on the harness guide disposed above the valve gear mechanism, the injector harness is upwardly apart from the valve gear mechanism. This advantageously minimizes the possibility of the injector harness interfering with the behavior of the valve gear mechanism.

According to the present invention, the engine further includes crank angle detecting means and rotation angle detecting means. The crank angle detecting means is for detecting a crank angle of a crankshaft. The rotation angle detecting means is for detecting a rotation angle of a rotation shaft configured to rotate in conjunction with the crankshaft. The engine is configured to carry out fuel injection and ignition on an individual cylinder basis based on detection information from the crank angle detecting means and the rotation angle detecting means. The rotation shaft includes a pump shaft at a fuel supply pump disposed adjacent to a suction manifold. A pump shaft pulser is disposed on the pump shaft. The rotation angle detecting means is disposed on a peripheral side of the pump shaft pulser. Thus, the rotation angle detecting means is disposed in the engine at the mounting side of the suction manifold, where the temperature is relatively low. In other words, the rotation angle detecting means and the other electronics/actuators, such as the crank angle detecting means, are collectively disposed on the mounting side of the suction manifold of the engine. This provides the advantageous effect of minimizing the adverse influence that the heat of the engine has on the rotation angle detecting means. Additionally, the electrical harness and like components are brought together into a compact form, which contributes to efficiency of the assembly work (connection work).

According to the present invention, a gear case is disposed at one side portion of a cylinder block. The gear case accommodates a crank gear on the crankshaft, a pump gear on the pump shaft, and an idle gear engaged with the crank gear and the pump gear. The pump shaft pulser is integrally rotatably mounted on the pump gear in the gear case. This ensures, as well as the advantageous effects of claim 2, that replacing the idle gear facilitates the driving of the fuel supply pump at an equal speed to the speed of the crankshaft or at half the speed of the crankshaft. This provides the advantageous effect of improving versatility of the configuration of the engine.

According to the present invention, the gear case includes an insertion portion in which the rotation angle detecting means is mounted to oppose to the pump shaft pulser. This ensures mounting of the rotation angle detecting means on the insertion portion from outside the gear case, thus simplifying the assembly work. This provides the advantageous effects of improving workability and contributing to reduction in process steps in the engine production line, as well as providing the advantageous effects of claims 4 and 5.

According to the present invention, a flywheel rotating integrally with the crankshaft is disposed at another side portion of the cylinder block. A crankshaft pulser corresponding to the crank angle detecting means and a starter ring gear are engaged and secured to a peripheral side of the flywheel from mutually opposite sides along a thickness direction of the flywheel. This facilitates modification of the positioning of the crankshaft pulser with the ring gear mounted on the flywheel even at, for example, the inspection stage of the engine. This provides the advantageous effect of improving workability of the modification operation of the crankshaft pulser. Additionally, the inner diameter of the crankshaft pulser and the inner diameter of the ring gear are independently settable. This advantageously improves the freedom of design of the flywheel shape and the like.

DESCRIPTION OF THE PREFERRED EMBODIMENTS

Figure 1:
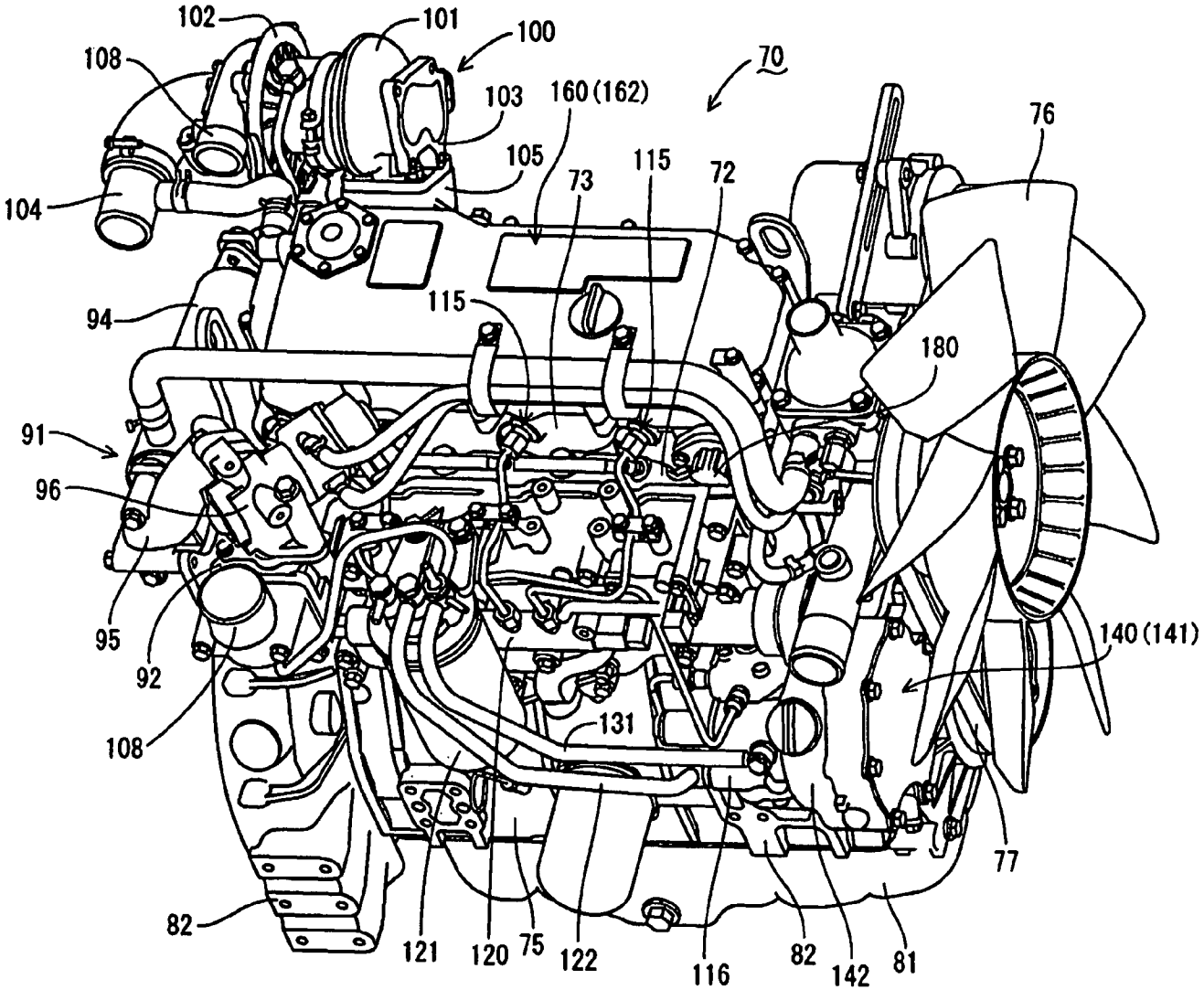
FIG. 1 is an external perspective view of a diesel engine.
Figure 2:
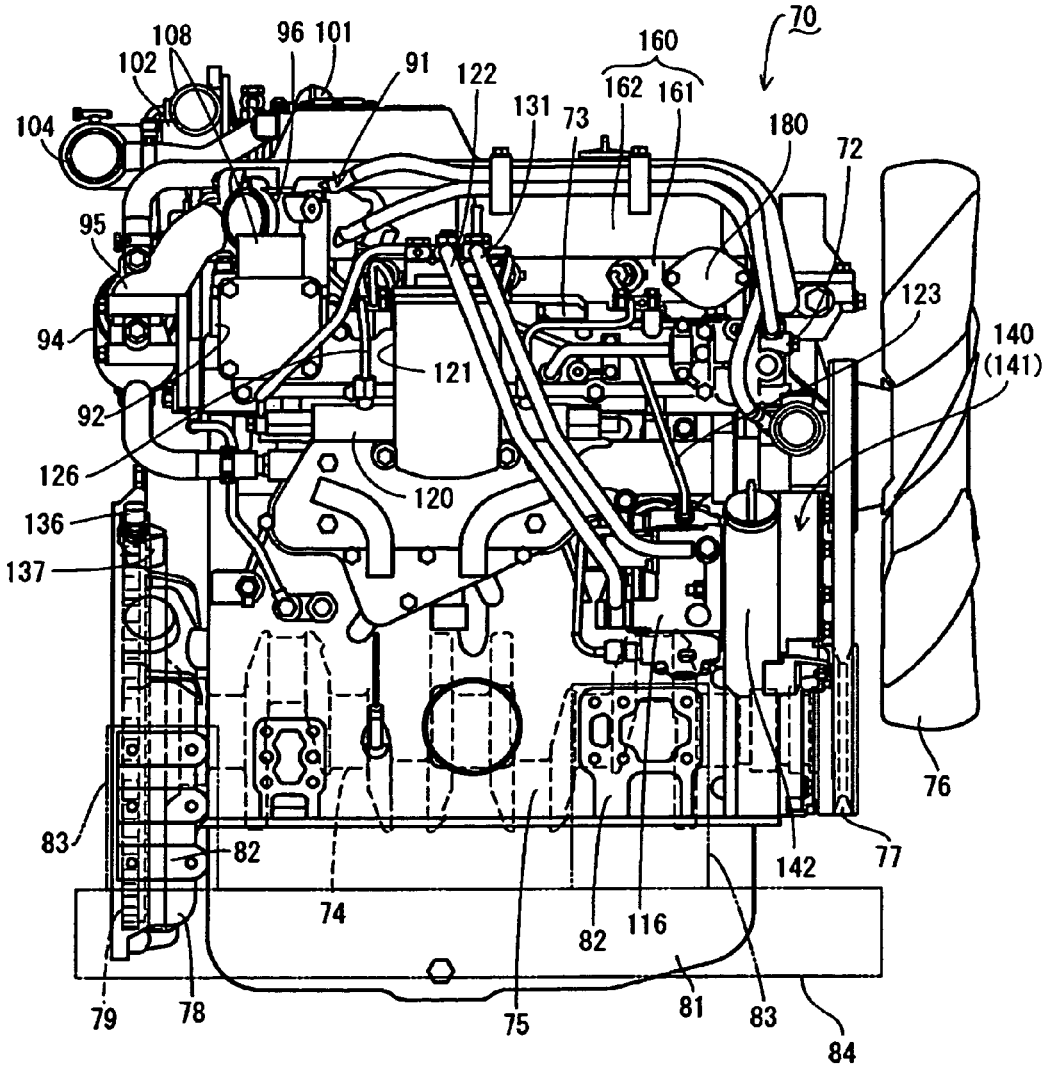
FIG. 2 is a side view of the diesel engine on the mounting side of a suction manifold.
Figure 3:
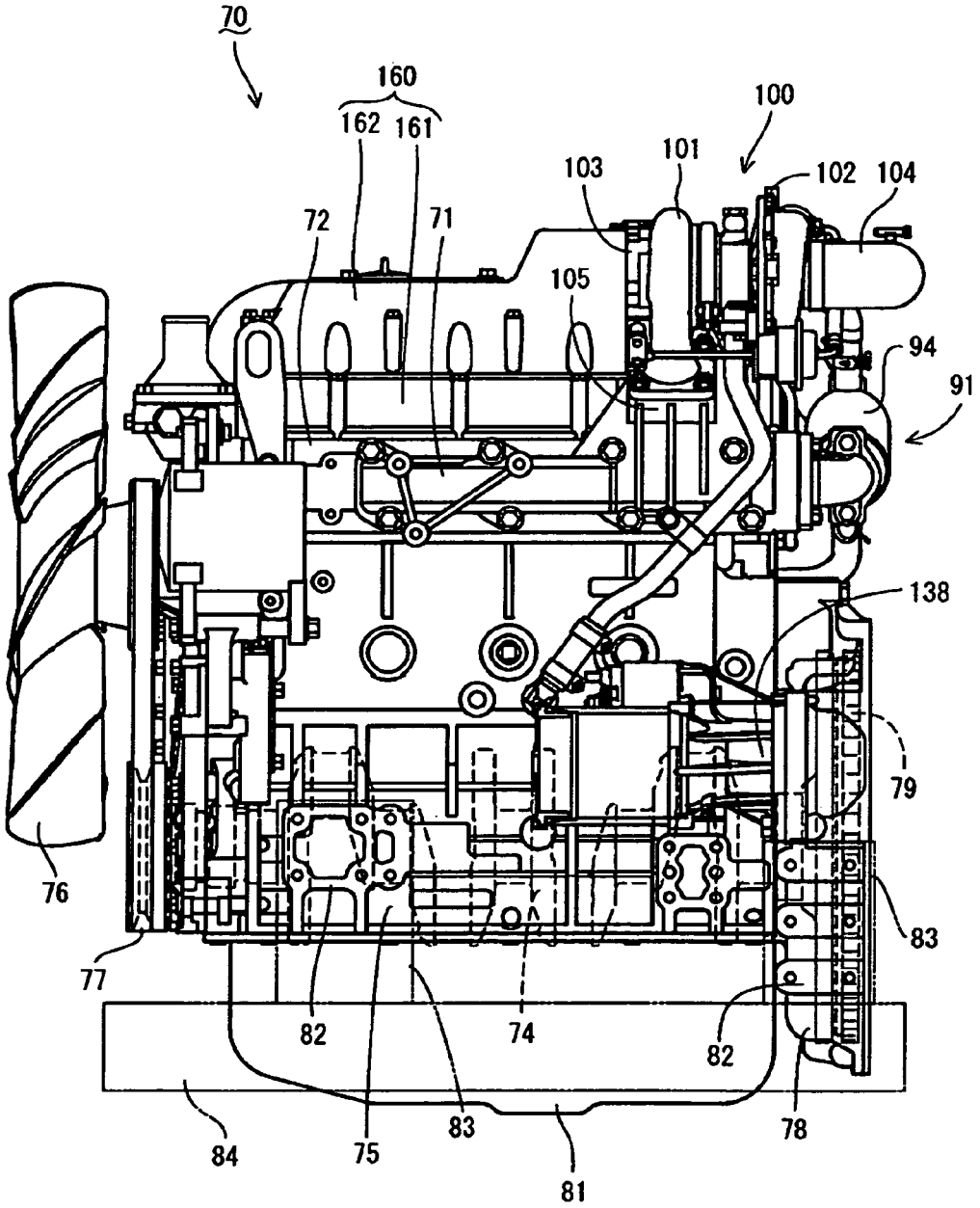
FIG. 3 is a side view of the side of the diesel engine on the mounting side of an exhaust manifold.
Figure 4:
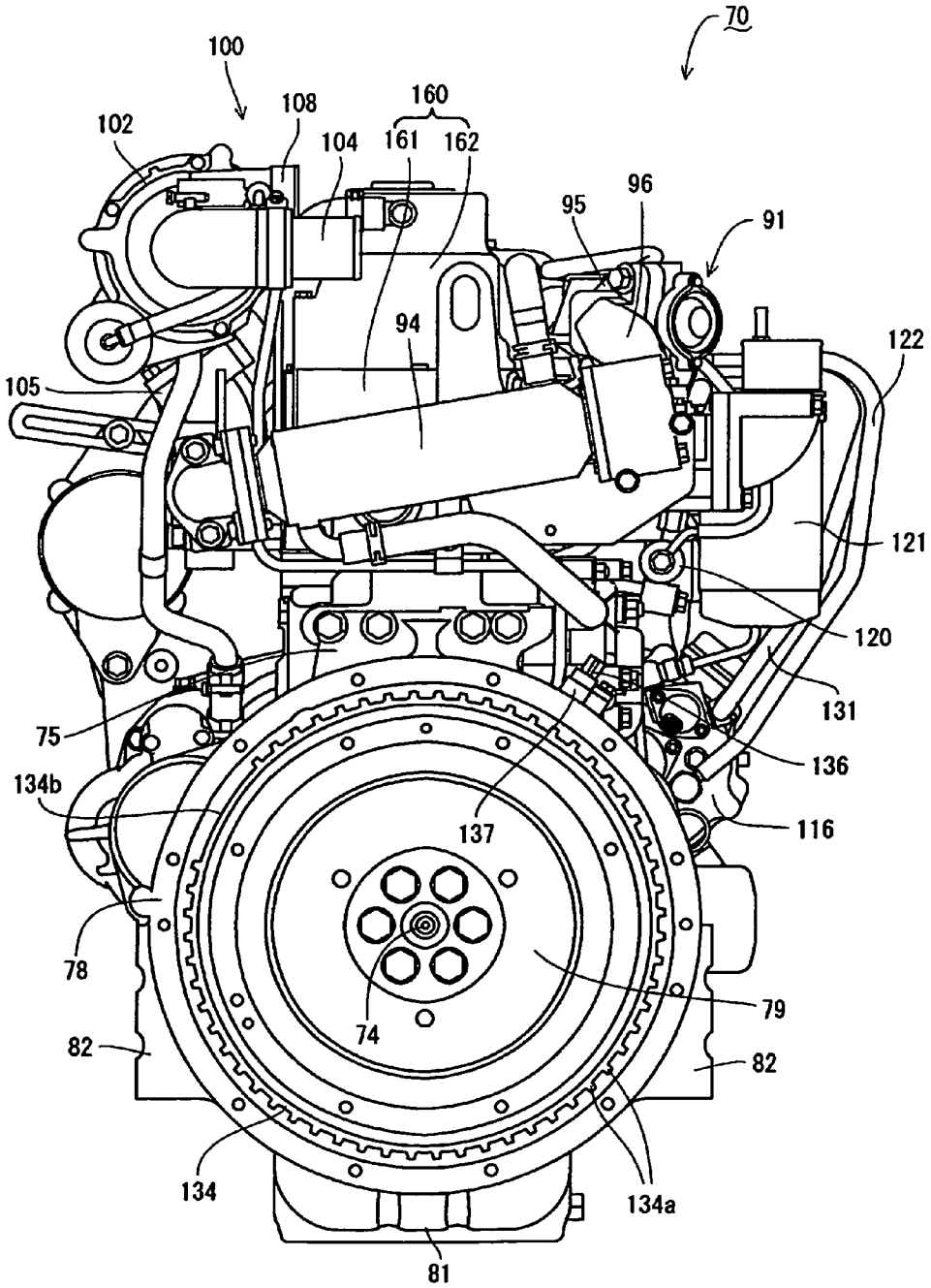
FIG. 4 is a side view of the diesel engine on the mounting side of a flywheel.
Figure 5:
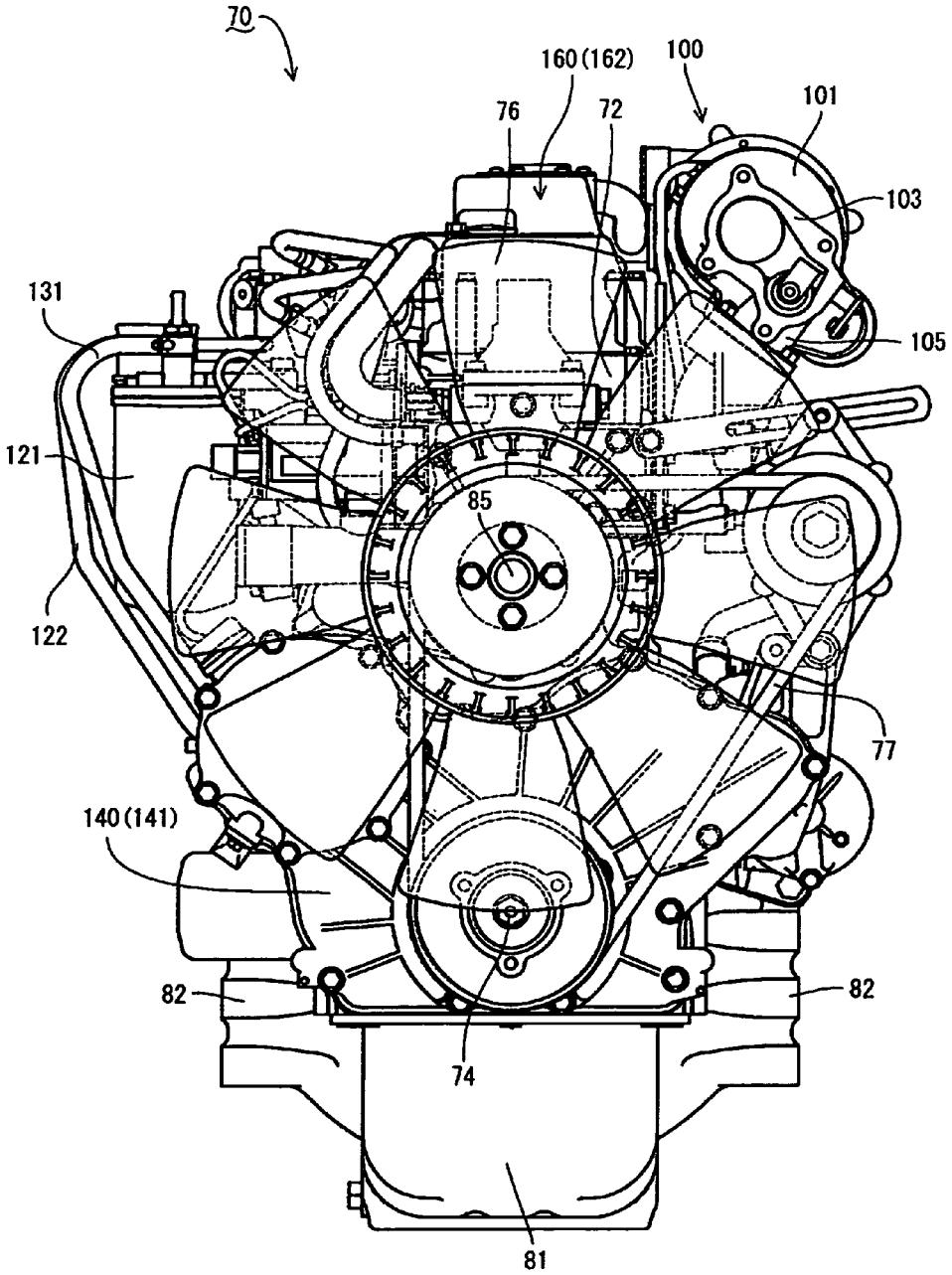
FIG. 5 is a side view of the side wherein a cooling fan of the diesel engine is mounted.
Figure 6:
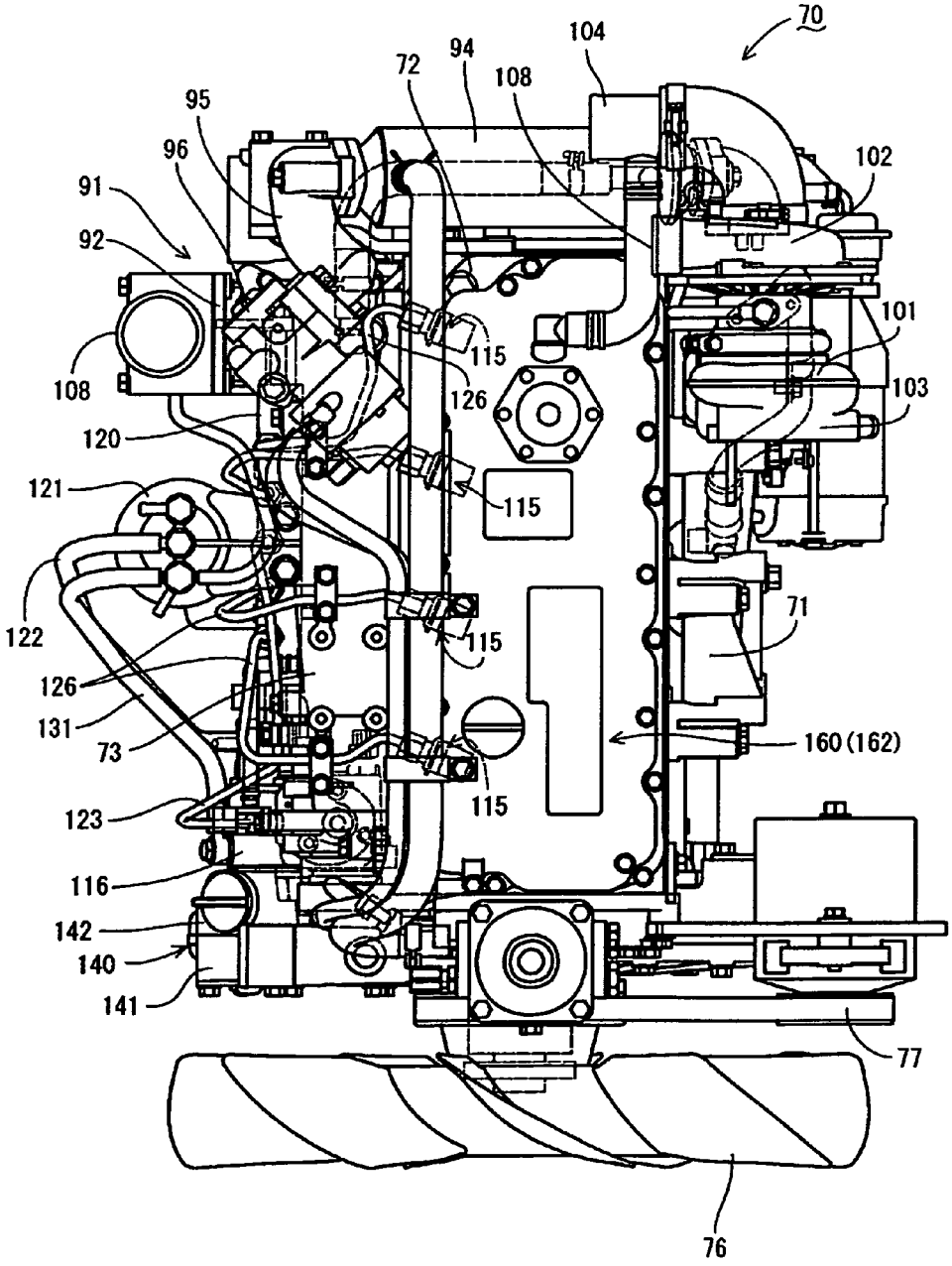
FIG. 6 is a plan view of the diesel engine.

Embodiments of the present invention will be described below by referring to the accompanying drawings. In the description of the diesel engine shown in FIGS. 1 to 15, the mounting side of a suction manifold of the diesel engine is referred to as the "right side", while the mounting side of an exhaust manifold is referred to as the "left side". For convenience of explanation, the right side and the left side serve as the basis of description of the directional and vertical positional relationships in the diesel engine.

(1) Overall Structure of the Diesel Engine

First, the overall structure of a diesel engine 70 will be described mainly by referring to FIGS. 1 to 6. The diesel engine 70 according to this embodiment is of four-cylinder type. In the diesel engine 70, an exhaust manifold 71 is disposed on the left-side surface of a cylinder head 72, while a suction manifold 73 is disposed on the right-side surface of the cylinder head 72. The cylinder head 72 is mounted on a cylinder block 75 that internally includes a crankshaft 74 and a piston (not shown). The front and rear ends of the crankshaft 74 respectively protrude from the front and rear side surfaces of the cylinder block 75. A cooling fan 76 is disposed on the front surface side of the cylinder block 75. A rotational force is transmitted from the front end side of the crankshaft 74 to the cooling fan 76 through a V-belt 77.

As shown in FIGS. 1 to 4, a flywheel housing 78 is secured on the rear surface of the cylinder block 75. A flywheel 79 is disposed in the flywheel housing 78. The flywheel 79 is pivotally supported on the rear end side of the crankshaft 74. The flywheel 79 rotates integrally with the crankshaft 74. Through the flywheel 79, the power of the diesel engine 70 is retrieved to the driving section of an operation unit such as a tractor 201 and an common combine harvester 300, described later.

Figure 11:
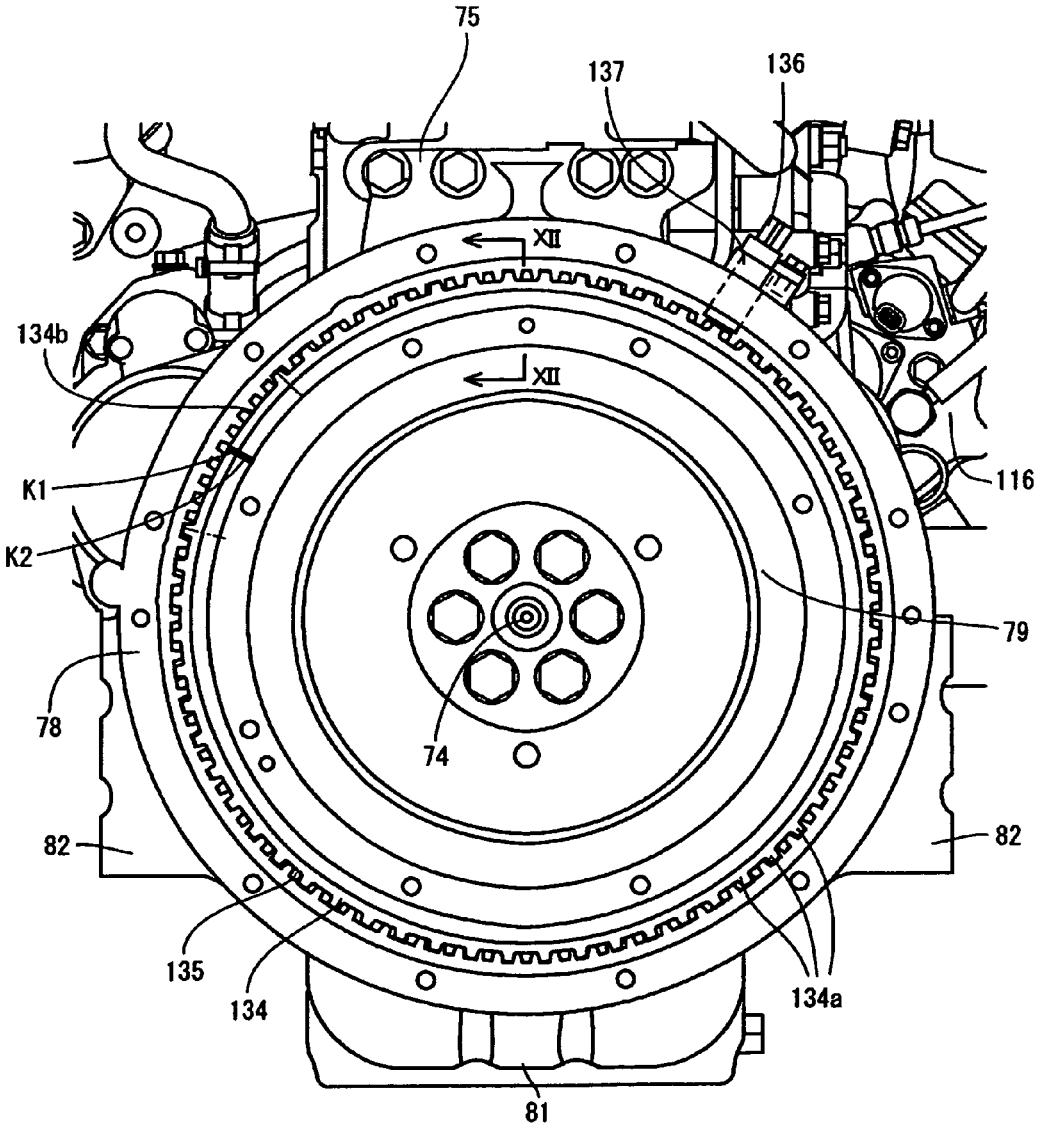
FIG. 11 is an enlarged front view of the flywheel.
Figure 12:
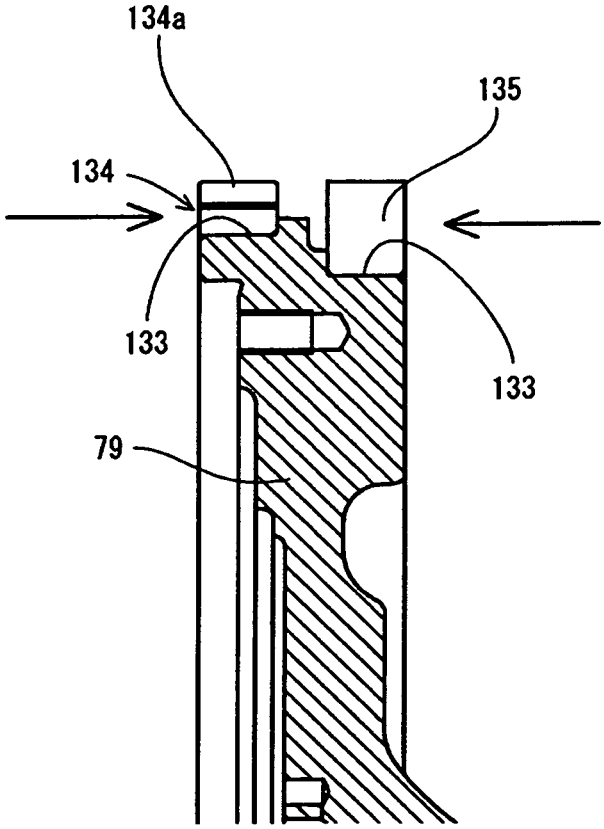
FIG. 12 is a cross-sectional view taken along the line XII-XII of FIG. 11.

As shown in FIGS. 11 and 12, an annular crankshaft pulser 134 and a ring gear 135 for a starter (motor) 138 are engaged and secured to the peripheral side of the flywheel 79 from mutually opposite sides along the thickness direction of the flywheel 79. In this case, a central portion of the peripheral surface of the flywheel 79 in the thickness direction protrudes radially outward to form an engagement step portion 133, which has a step (outward convex) shape. The crankshaft pulser 134 is mounted by press fitting or shrink fitting on the front side of the engagement step portion 133, which is far from the cylinder block 75. The ring gear 135 is mounted by press fitting or shrink fitting on the backside of the engagement step portion 133, which is near the cylinder block 75.

On the peripheral surface of the crankshaft pulser 134, output projections 134*a* serving as detected portions are arranged at predetermined crank angles (rotation angles). A lost tooth portion 134*b* is formed on a portion of the peripheral surface of the crankshaft pulser 134 corresponding to the top dead center (TDC) of, for example, the first or fourth cylinder. Adjacent to the peripheral side of the crankshaft pulser 134, a crank angle sensor 136 serving as crank angle detecting means is disposed in opposition to the output projection 134*a* and the lost tooth portion 134*b*. The crank angle sensor 136 detects the crank angle (rotation angle) of the crankshaft 74. The crank angle sensor 136 outputs a crank angle signal when the output projection 134*a* of the crankshaft pulser 134 passes near the crank angle sensor 136 in conjunction with the rotation of the crankshaft 74. The crank angle sensor 136 according to this embodiment is detachably mounted in a sensor insertion portion 137 (see FIG. 2), which is formed on the upper right side of the flywheel housing 78.

The starter (motor) 138 having a pinion gear (not shown) on the output shaft is mounted on the left side of the flywheel housing 78. The pinion gear of the starter 138 is engaged with the ring gear 135 of the flywheel 79. At the start of the diesel engine 70, the rotative power of the starter 138 rotates the ring gear 135 of the flywheel 79, which starts the crankshaft 74 to rotate (to execute what is called cranking).

A mark-off line K1 that serves as a marker for positioning is drawn on a side surface of the crankshaft pulser 134 far from the cylinder block 75 and at, for example, a lost tooth portion 134*b*. A mark-off line K2 corresponding to the mark-off line K1 on the side of the crankshaft pulser is drawn on a peripheral portion of a surface side of the flywheel 79 far from the cylinder block 75. During the mounting of the crankshaft pulser 134 on the engagement step portion 133 of the flywheel 79, linearly aligning the mark-off lines K1 and K2 facilitates the positioning of the crankshaft pulser 134 relative to the engagement step portion 133 of the flywheel 79.

The positions of the mark-off lines K1 and K2 will not be limited to the example described above. For example, the mark-off lines can be provided at any one of the output projections 134*a* adjacent to the lost tooth portion 134*b* of the crankshaft pulser 134, and at a corresponding peripheral portion of the flywheel 79. The existence of the mark-off lines K1 and K2 adjacent to the lost tooth portion 134*b* is preferred in that visual confirmation is facilitated.

With the above-described configuration, the flywheel 79 rotating integrally with the crankshaft 74 is disposed at the other side portion (the rear surface side) of the cylinder block 75. The crankshaft pulser 134 corresponding to the crank angle detecting means 136 and the ring gear 135 for the starter 138 are engaged and secured to the peripheral side of the flywheel 79 from mutually opposite sides along the thickness direction of the flywheel 79. This facilitates modification of the positioning of the crankshaft pulser 134 with the ring gear 135 mounted on the flywheel 79 even at, for example, the inspection stage of the diesel engine 70. This improves workability of the modification operation of the crankshaft pulser 134. Additionally, the inner diameter of the crankshaft pulser 134 and the inner diameter of the ring gear 135 are independently settable. This improves the freedom of design of the flywheel 79 shape and the like.

Additionally, the crankshaft pulser 134 is mounted on the flywheel 79 in line with the mark-off lines K1 and K2. This eliminates the need for a dedicated jig for positioning during mounting of the crankshaft pulser 134, and facilitates the positioning through visual observation, resulting in preferable workability of the mounting operation. Further, a misalignment, if any, of the mounting point of the crankshaft pulser 134 can be visually inspected and confirmed, which improves workability of the inspection operation as well.

An oil pan 81 is disposed on the lower surface of the cylinder block 75. Engine leg attachment portions 82 are mounted on the right and left side surfaces of the cylinder block 75 and on the right and left side surfaces of the flywheel housing 78. On the engine leg attachment portions 82, engine leg bodies 83 having a shock-proof rubber are bolt-jointed. The diesel engine 70 is supported in a shock-proofing manner to an engine support chassis 84 of the above-described operation unit through the engine support legs 83.

As shown in FIGS. 1, 2, 4 and 6, to the entrance side of the suction manifold 73, an air cleaner (not shown) is coupled through a collector 92 that constitutes an EGR device 91 (exhaust gas recirculation device). Ambient air subjected to dust removal and cleaning through the air cleaner is fed to the suction manifold 73 through the collector 92 of the EGR device 91, and then supplied to each cylinder of the diesel engine 70.

As shown in FIGS. 1, 2, 4 and 6, the EGR device 91 includes: the collector (the EGR main body case) 92 that mixes recirculating exhaust gas (EGR gas from the exhaust manifold 71) with new air (outside air from the air cleaner) to supply the mixture to the suction manifold 73; a recirculating exhaust gas pipe 95 coupled to the exhaust manifold 71 through an EGR cooler 94; and an EGR valve 96 that communicates the collector 92 to the recirculating exhaust gas pipe 95.

With the above-described configuration, outside air is supplied into the collector 92 from the air cleaner, while EGR gas (part of exhaust gas exhausted from the exhaust manifold 71) is supplied into the collector 92 from the exhaust manifold 71 through the EGR valve 96. The outside air from the air cleaner and the EGR gas from the exhaust manifold 71 are mixed in the collector 92, and the mixture gas in the collector 92 is supplied to the suction manifold 73. That is, part of the exhaust gas exhausted to the exhaust manifold 71 from the diesel engine 70 is refluxed to the diesel engine 70 from the suction manifold 73. This lowers the maximum temperature of combustion during a high load operation, thereby reducing the amount of emission of NOx (nitrogen oxides) from the diesel engine 70.

As shown in FIGS. 1 and 3 to 6, a turbosupercharger 100 is mounted on the left side surface of the cylinder head 72. The turbosupercharger 100 includes: a turbine case 101 internally including a turbine wheel (not shown); and a compressor case 102 internally including a blower wheel (not shown). The exhaust manifold 71 is coupled to an exhaust-gas intake pipe 105 of the turbine case 101. A tail pipe, not shown, is coupled to an exhaust gas exhaust pipe 103 of the turbine case 101 through a muffler, a diesel particulate filter, or the like. That is, the exhaust gas exhausted to the exhaust manifold 71 from each cylinder of the diesel engine 70 is exhausted to the outside from the tail pipe through the turbosupercharger 100 and other elements.

The suction-gas discharge side of the air cleaner is coupled to the suction-gas intake side of the compressor case 102 through a suction pipe 104. The suction manifold 73 is coupled to the suction-gas discharge side of the compressor case 102 through a supercharging pipe 108. That is, ambient air subjected to dust removal through the air cleaner is supplied to each cylinder of the diesel engine 70 from the compressor case 102 through the supercharging pipe 108.

(2) Fuel System Structure of the Common-Rail System and the Diesel Engine

Next, by referring to FIGS. 1 to 7, the fuel system structure of a common-rail system 117 and the diesel engine 70 will be described. As shown in FIGS. 1, 2, 6 and 7, through the common-rail system 117 and a fuel supply pump 116, a fuel tank 118 is coupled to injectors 115 that correspond to the respective four cylinders and are disposed in the diesel engine 70. The injectors 115 each include an electromagnetic switch control type of fuel injection valve 119. The common-rail system 117 includes a cylindrical common rail 120.

As shown in FIGS. 1, 2, 6, and 7, the fuel tank 118 is coupled to the inlet side of the fuel supply pump 116 through a fuel filter 121 and a low-pressure pipe 122. The fuel in the fuel tank 118 is sucked into the fuel supply pump 116 through the fuel filter 121 and the low-pressure pipe 122. The fuel supply pump 116 according to this embodiment is disposed adjacent to the suction manifold 73. Specifically, the fuel supply pump 116 is disposed on the right surface side of the cylinder block 75 (on the mounting side of the suction manifold 73) and on the lower side of the suction manifold 73. The common rail 120 is coupled to the discharge side of the fuel supply pump 116 through a high-pressure pipe 123. The injectors 115 dedicated to the respective four cylinders are coupled to the common rail 120 through four fuel injection pipes.

With the above-described configuration, the fuel in the fuel tank 118 is pressure-fed to the common rail 120 by the fuel supply pump 116, and the high-pressure fuel is stored in the common rail 120. Each of the fuel injection valves 119 is openably and closably controlled to inject the high-pressure fuel in the common rail 120 into each of the cylinders of the diesel engine 70 through each of the injectors 115. That is, electronically controlling each of the fuel injection valves 119 ensures highly accurate control of the injection pressure, injection timing, and injection period (injection quantity) of the fuel supplied through each of the injectors 115. This reduces the amount of nitrogen oxides (NOx) from the diesel engine 70 and reduces noise-associated vibration of the diesel engine 70.

Figure 7:
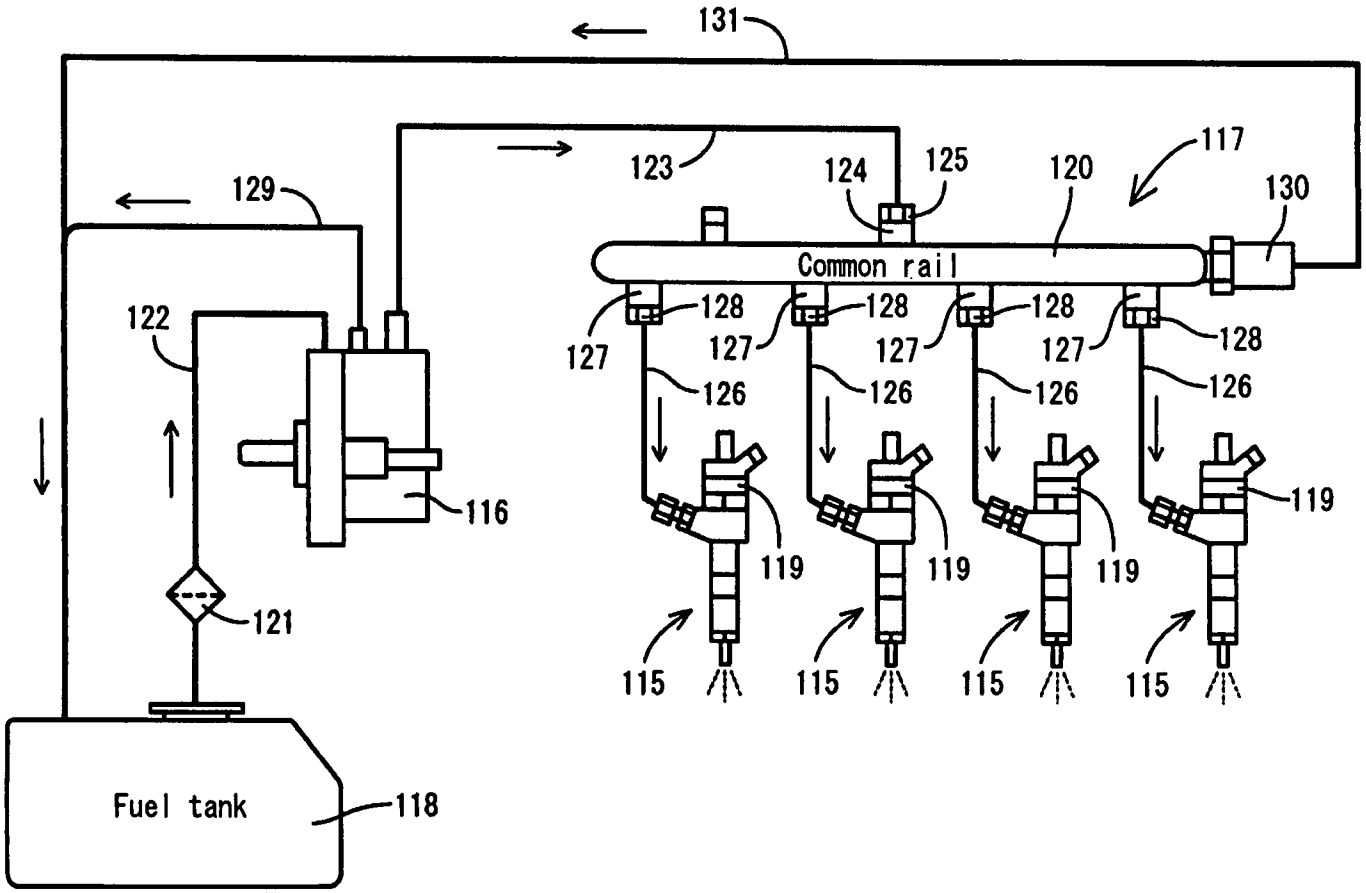
FIG. 7 is a diagram illustrating a fuel system of the diesel engine.

As shown in FIG. 7, the fuel supply pump 116 is coupled to the fuel tank 118 through a fuel return pipe 129. To a longitudinal end of the cylindrical common rail 120, which has a cylindrical shape, a common rail return pipe 131 is coupled through a return pipe connector 130 that regulates the pressure of the fuel disposed in the common rail 120. That is, an excess of fuel in the fuel supply pump 116 and an excess of fuel in the common rail 120 are recovered into the fuel tank 118 through the fuel return pipe 129 and the common rail return pipe 131.

(3) Cylinder Discriminating Structure and Gear Train Structure of the Diesel Engine Next, by referring to FIGS. 4, 5, and 8 to 10, a cylinder discriminating structure and a gear train structure of the diesel engine 70 will be described. First, a conventional cylinder discriminating structure will be briefly described. Conventionally, an engine mounted on a vehicle carries out cylinder discrimination based on the combination of a crank angle signal output from a crank angle sensor in accordance with the rotation of the crankshaft; and a cam angle signal output from a cam angle sensor in accordance with the rotation of the cam shaft. The engine then carries out fuel injection and ignition on an individual cylinder basis based on the cylinder discrimination result. The fuel injection and ignition carried out on an individual cylinder basis drives the engine (see, for example, Japanese Unexamined Patent Application No. 2004-44440). As used herein, the term cylinder discrimination means identifying the crank angle (rotational position) of the crankshaft at one cycle (720° CA) of the engine.

In this type of engine, a flywheel that integrally rotates with the crankshaft is disposed on one side portion of the engine in the crankshaft direction (for convenience of description, the one side portion will be referred to as the rear surface side of the engine). Adjacent to the peripheral side of a crankshaft pulser mounted on the flywheel, a crank angle sensor is disposed. The crank angle sensor outputs a crank angle signal when a detected portion of the crankshaft pulser passes near the crank angle sensor in conjunction with the rotation of the crankshaft.

Additionally, on the front surface side of the engine (the other side portion in the crankshaft direction), a crank gear secured to the crankshaft, and a cam gear secured to the cam shaft are disposed. In conjunction with the crank gear, the cam gear and the cam shaft rotate to drive a valve gear mechanism associated with the cam shaft, thus openably and closably operating the suction valve and the exhaust valve of the engine. To the peripheral side of a cam shaft pulser attached to the cam gear, a cam angle sensor is disposed. The cam angle sensor outputs a cam angle signal when a detected portion of the cam shaft pulser passes near the cam angle sensor in conjunction with the rotation of the cam shaft.

Recent engines are electronically controlled using electronic components such as various sensors and controllers, considering efficient driving and handling of exhaust gas. In order to minimize the adverse influence of the heat of the engine, these electronic components and actuators and like elements that are operatively controlled by the electronic components are collectively disposed on the right surface side (the mounting side of the suction manifold) of the engine, where the temperature is relatively low. Also on the right surface side of the engine, a fuel supply pump for supplying fuel to the engine is disposed. Further on the right surface side of the engine, a fuel supply pathway from the fuel supply pump is disposed. Considering that the fuel supply pathway is located on the right surface side of the engine, the cam gear and the cam shaft are disposed adjacent to the left surface side of the front surface side of the engine (adjacent to the mounting side of the exhaust manifold). For this reason, the cam angle sensor is also disposed adjacent to the left surface side of the front surface side of the engine.

Since the cam angle sensor is located at a position of the engine where the temperature is relatively high, a problem arises in that the cam angle sensor is subject to adverse effects of the heat of the engine. Additionally, since the cam angle sensor is disposed apart from the other electronic components, a necessity arises to elongate the harness to be coupled to the cam angle sensor. Further, a cooling fan and a fan belt are oftentimes disposed on the front surface side of the engine, where the cam gear and the crank gear are disposed. This necessitates avoiding the cooling fan and the fan belt when the harness to be coupled to the cam angle sensor is wired to the right surface side of the engine (the mounting side of the suction manifold). Thus, there is room for improvement in wiring workability. Additionally, the circumvention in coupling the harness to the cam angle sensor necessitates consideration of the arrangement and number of clamp parts, serving as a cause of increased cost.

The cylinder discriminating structure described below is an improvement accomplished in view of the above-described circumstances. As shown in FIGS. 5 and 8 to 10, a dividable gear case 140 including a case lid 141 and a case main body 142 is secured to the front surface side of the cylinder block 75. The gear case 140 according to this embodiment is located below a fan shaft 85 that pivotally supports a cooling fan 75.

The front end side of the crankshaft 74, which protrudes from the front surface of the cylinder block 75, penetrates through the case main body 142 of the gear case 140. A crank gear 143 is secured to a front apical portion of the crankshaft 74. In the cylinder block 75, a cam shaft 144 that extends in parallel with the rotation axis center of the crankshaft 74 is pivotally supported. The cam shaft 144 according to this embodiment is disposed adjacent to the left surface side of the interior of the cylinder block 75 (adjacent to the mounting side of the exhaust manifold 71). The front end side of the cam shaft 144 penetrates through the case main body 142 of the gear case 140, similarly to the crankshaft 74. A cam gear 145 is secured to a front apical portion of the cam shaft 144.

The fuel supply pump 116 mounted on the right surface side of the diesel engine 70 includes a pump shaft 146 as a rotation shaft that extends in parallel with the rotation axis center of the crankshaft 74. The front end side of the pump shaft 146 penetrates through the case main body 142 of the gear case 140, similarly to the crankshaft 74 and the cam shaft 144. A pump gear 147 is secured to a front apical portion of the pump shaft 146.

At a position of the case main body 142 surrounded by the crankshaft 74, the cam shaft 144, and the pump shaft 146, an idle shaft 148 is disposed that extends in parallel with the rotation axis center of the crankshaft 74. The idle shaft 148 penetrates through the case main body 142 to be secured to the front surface of the cylinder block 75. The idle shaft 148 pivotally supports an idle gear 149. The idle gear 149 is engaged with three gears, namely, the crank gear 143, the cam gear 145, and the pump gear 147. The rotative power of the crankshaft 74 is transmitted to both the cam gear 145 and the pump gear 147 from the crank gear 143 through the idle gear 149. This results in the cam shaft 144 and the pump shaft 146 rotating in conjunction with the crankshaft 74. In this embodiment, the gear ratio among the gears 143, 145, 147, and 149 is set to ensure that the cam shaft 144 and the pump shaft 146 each make one rotation for every two rotations of the crankshaft 74.

In this case, the cam gear 145 and the cam shaft 144 rotate in conjunction with the crank gear 143, which rotates with the crankshaft 74, to drive a valve gear mechanism 163 (see FIGS. 13 to 15) disposed in association with the cam shaft 144, thus openably and closably operating a suction valve 164 and an exhaust valve 165 (see FIGS. 13 to 15) mounted on the cylinder head 72. Additionally, the pump gear 147 and the pump shaft 146 rotate in conjunction with the crank gear 143 to drive the fuel supply pump 116. This causes the fuel in the fuel tank 118 to be pressure-fed to the common rail 120, so that the high-pressure fuel is stored in the common rail 120.

Figure 8:
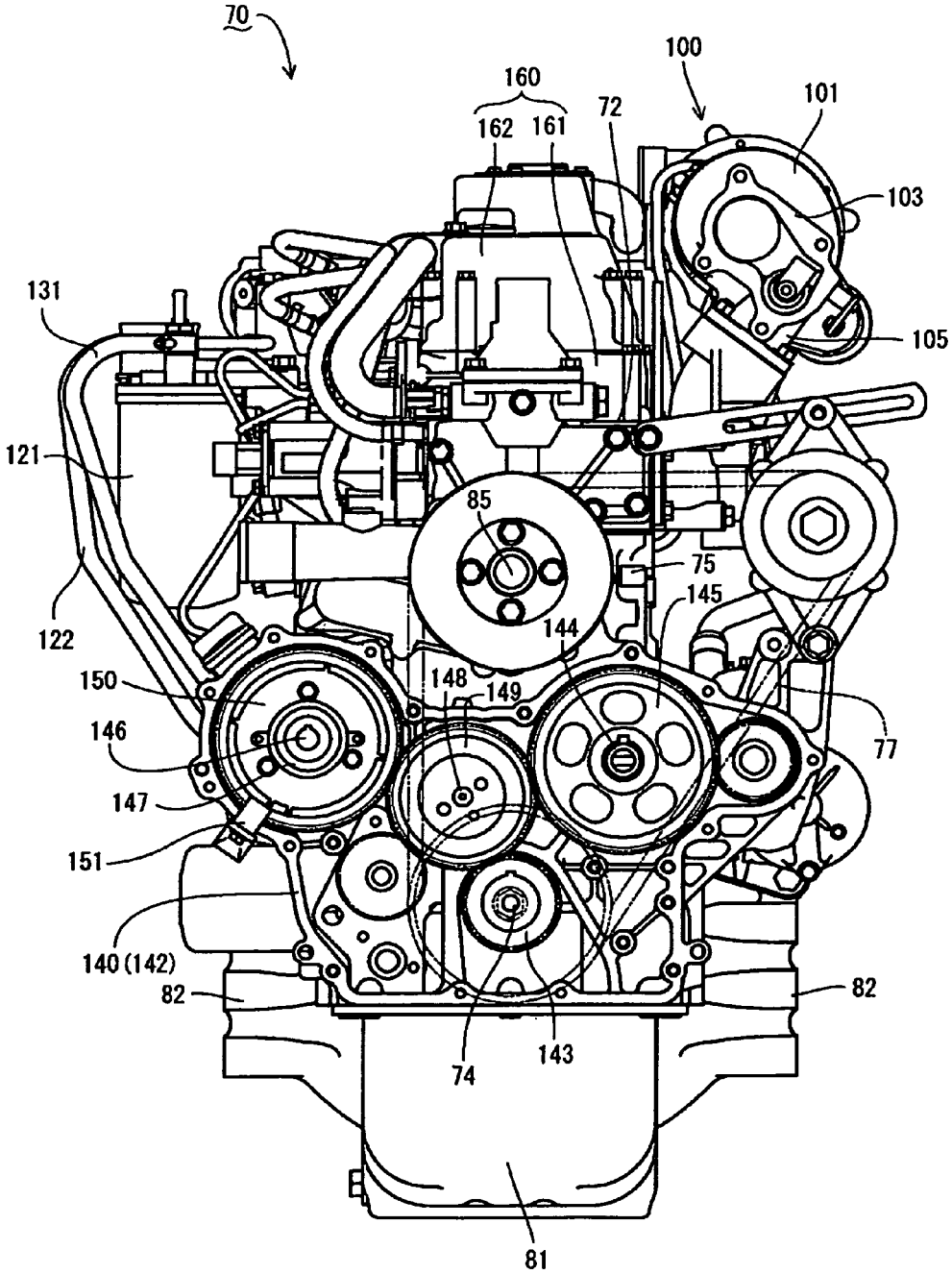
FIG. 8 is a side view of the diesel engine illustrating the gear train.
Figure 9:
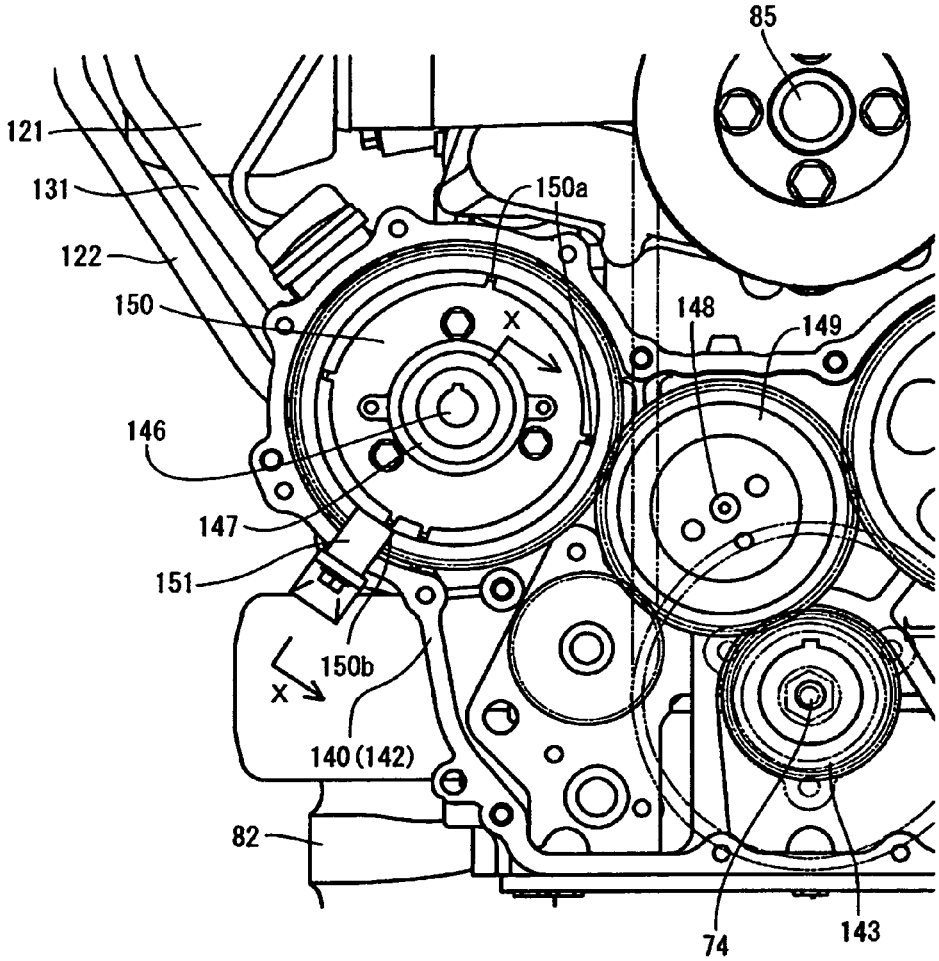
FIG. 9 is a partially enlarged view of FIG. 8.
Figure 10:
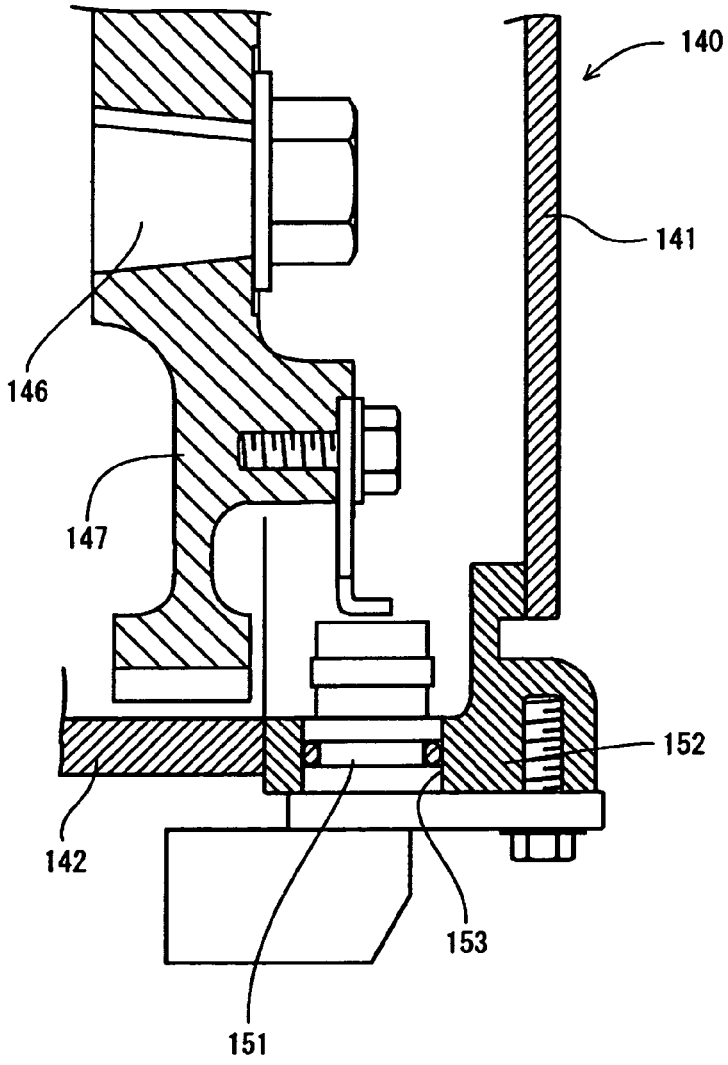
FIG. 10 is a cross-sectional view taken along the line X-X of FIG. 9.

As detailed in FIGS. 8 to 10, to the side surface of the pump gear 147 on the side of the case lid 141, a pump shaft pulser 150 in the form of an extended play record is bolt-jointed so as to integrally rotate with the pump gear 147. On the peripheral surface of the pump shaft pulser 150, output projections 150*a* serving as detected portions are formed at 90° intervals (at 180° crank angles). An extra tooth 150*b* is formed on a part of the circumferential surface of the pump shaft pulser 150 immediately in front (the upstream side of rotation) of the output projection 150*a* corresponding to the top dead center of the first cylinder. Adjacent to the peripheral side of the pump shaft pulser 150, a pump shaft rotation angle sensor 151 serving as rotation angle detecting means is disposed in opposition to the output projection 150*a* and the extra tooth 150*b*. The pump shaft rotation angle sensor 151 is detects the rotation angle of the pump shaft 146. The pump shaft rotation angle sensor 151 outputs a rotation angle signal when the output projection 150*a* and the extra tooth 150*b* of the pump shaft pulser 150 passes near the pump shaft rotation angle sensor 151 in conjunction with the rotation of the pump shaft 146.

The crank angle signal being output from the crank angle sensor 136 in conjunction with the rotation of the crankshaft 74, and the rotation angle signal output from the pump shaft rotation angle sensor 151 in conjunction with the rotation of the pump shaft 146 are input into a controller (not shown). The controller uses the signals to carry out arithmetic operations as to cylinder discrimination and a crank angle, and electronically controls each of the fuel injection valves 119 based on the operation results (that is, fuel injection and ignition are carried out with respect to each cylinder). This, as a result, ensures highly accurate control of the injection pressure, injection timing, and injection period (injection quantity) of the fuel supplied through each of the injectors 115.

The pump shaft rotation angle sensor 151 according to this embodiment is detachably mounted in an insertion portion 152 formed on the left side portion of the gear case 140. In this case, on the left side portion of the case lid 141, a through hole 153 penetrating through the gear case 140 is formed. The pump shaft rotation angle sensor 151 is inserted through the through hole 153 from the outside and secured in the through hole 153. The portion of the case lid 141 in which the through hole 153 is formed constitutes the insertion portion 152.

With the above-described configuration, the engine 70 includes: the crank angle detecting means 136 for detecting the crank angle (rotation angle) of the crankshaft 74; and the rotation angle detecting means 151 for detecting the rotation angle of the rotation shaft that rotates in conjunction with the crankshaft 74. The engine 70 carries out fuel injection and ignition on an individual cylinder basis based on detection information from the crank angle detecting means 136 and the rotation angle detecting means 151. The pump shaft 146 as a rotation shaft is disposed at the fuel supply pump 116 disposed adjacent to the suction manifold 73. The pump shaft pulser 150 is disposed on the pump shaft 146. The rotation angle detecting means 151 is disposed on the peripheral side of the pump shaft pulser 150. Thus, the rotation angle detecting means 151 is disposed in the engine 70 at the mounting side of the suction manifold 73, where the temperature is relatively low. In other words, the rotation angle detecting means 151 and the other electronics/actuators, such as the crank angle detecting means 136, are collectively disposed on the mounting side of the suction manifold 73 of the engine 70. This minimizes the adverse influence that the heat of the engine 70 has on the rotation angle detecting means 151. Additionally, the electrical harness and like components are brought together into a compact form, which contributes to efficiency of the assembly work (connection work).

Further, the gear case 140 is disposed at one side portion (the front surface side) of the cylinder block 75 to accommodate the crank gear 143 on the crankshaft 74, the pump gear 147 on the pump shaft 146, and the idle gear 149 engaged with the crank gear 143 and the pump gear 147. The pump shaft pulser 150 is integrally rotatably mounted on the pump gear 147 in the gear case 140. This ensures, as well as the above-described advantageous effects, that replacing the idle gear 149 facilitates the driving of the fuel supply pump 116 at an equal speed to the speed of the crankshaft 74, and facilitates the rotational driving of the fuel supply pump 116 at half the speed of the crankshaft 74. This improves versatility of the configuration of the engine 70.

Additionally, the gear case 140 includes the insertion portion 152 in which the rotation angle detecting means 151 is mounted to oppose to the pump shaft pulser 150. This ensures mounting of the rotation angle detecting means 151 on the insertion portion 152 from outside the gear case 140, thus simplifying the assembly work. This improves workability and contributes to reduction in process steps in the engine production line, as well as providing the above-described advantageous effects.

(4) Upper Structure of the Diesel Engine

Figure 13:
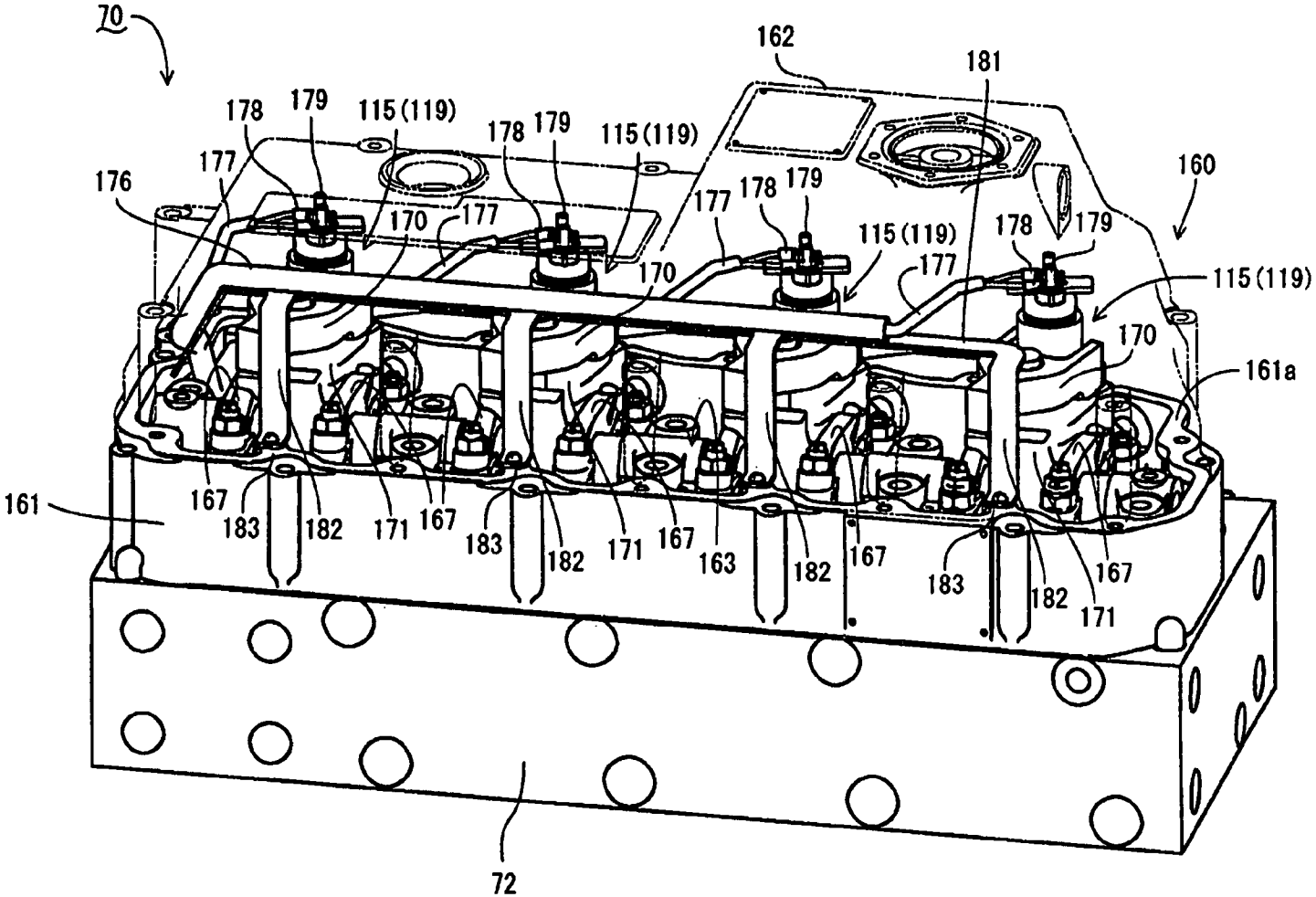
FIG. 13 is a perspective view of an upper portion of the diesel engine with an upper cover body omitted.
Figure 14:
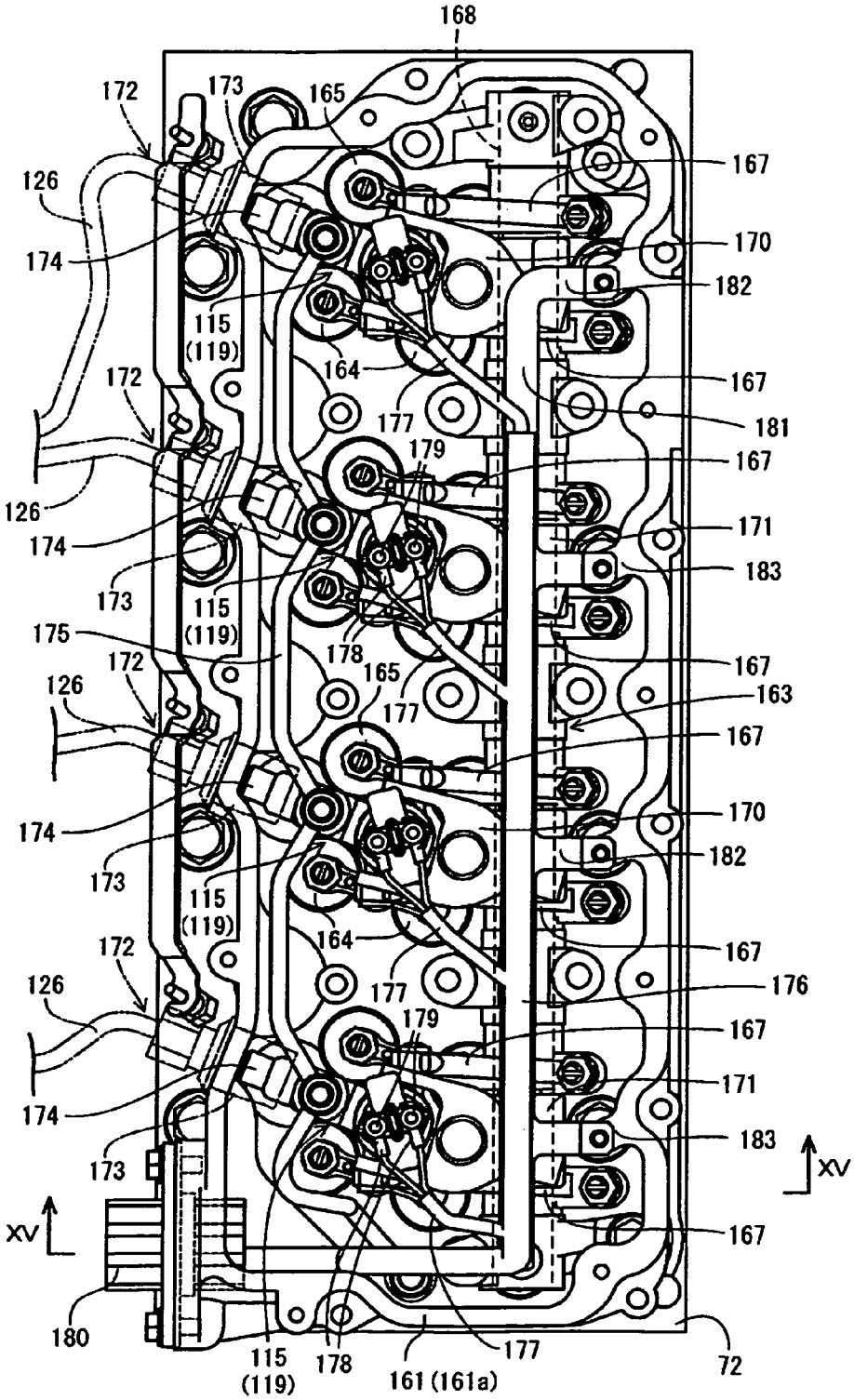
FIG. 14 is a plan view of the upper portion of the diesel engine with the upper cover body omitted.
Figure 15:
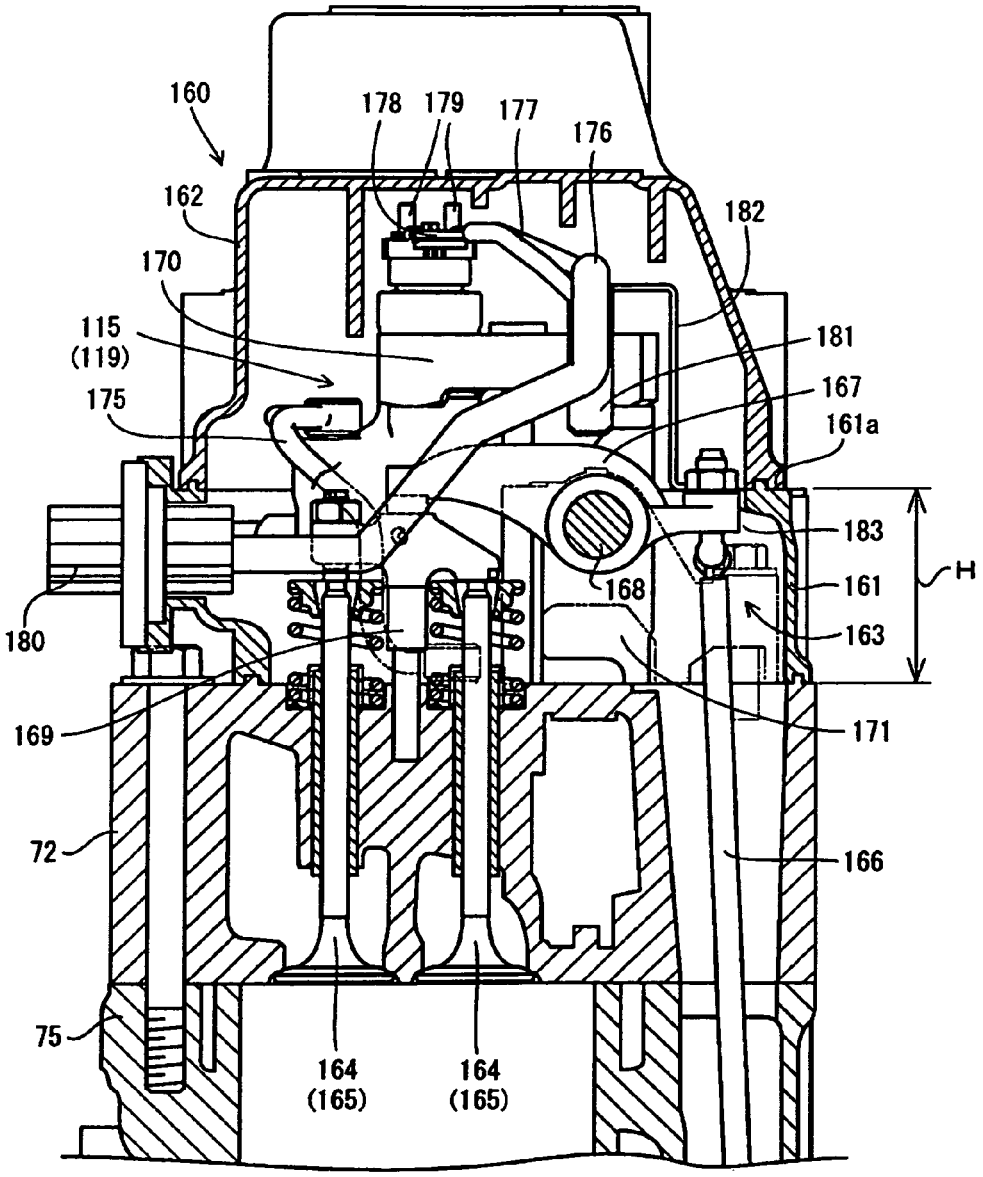
FIG. 15 is a cross-sectional view taken along the line XV-XV of FIG. 14.

Next, by referring to FIGS. 13 to 15, the upper structure of the diesel engine 70 will be described in detail. As shown in FIGS. 13 to 15, the upper surface of the cylinder head 72 of the diesel engine 70 is covered by a head cover 160. The head cover 160 is vertically dividable into a lower cover body 161 in the form of a surrounding wall and an upper cover body 162 in the form of a downwardly open lid. The upper cover body 162 is detachable from and attachable to the lower cover body 161. The head cover 160 defines a space serving as a valve arm chamber. The lower cover body 161 according to this embodiment is bolt jointed on the upper surface of the cylinder head 72. The upper cover body 162 is bolt-jointed on the side wall of the lower cover body 161. In the cylinder head 72, the valve gear mechanism 163 is disposed in association with the cam shaft 144, and fuel injection valves 119 (for respective four cylinders in this embodiment) constituting injectors 115 are disposed upright. Also in the cylinder head 72, suction valves 164 and exhaust valves 165 are disposed corresponding to the respective cylinders. The diesel engine 70 according to this embodiment is of four-valve type, with two suction valves 164 and two exhaust valves 165 per cylinder.

The diesel engine 70 is of OHV type, such that the valve gear mechanism 163 includes: a pushrod 166 that vertically moves in conjunction with a suction and exhaust cam (not shown) mounted on the cam shaft 144; and a valve arm 167 that swings about a horizontally long valve arm shaft 168 disposed in the head cover 160, in conjunction with the vertical movement of the pushrod 166. The top edge side of the pushrod 166 penetrates through the cylinder head 72 and protrudes into the head cover 160. The top edge side of the pushrod 166 is coupled to one end side of the valve arm 167. The other end side of the valve arm 167 is in contact with the two suction valves 164 (or the two exhaust valves 165) through a valve bridge 169. The pushrod 166 vertically moves in conjunction with the rotation of the cam shaft 144 to cause the valve arm 167 to swing about the valve arm shaft 168, thus openably and closably operating the pair of suction valves 164 and the pair of exhaust valves 165 of each cylinder. In this embodiment, one valve arm 167 is dedicated to one pair of suction valves 164 of each cylinder, and another valve arm 167 is dedicated to one pair of exhaust valves 165 of each cylinder. That is, two valve arms 167 are disposed per cylinder (a total of eight valve arms 167).

The fuel injection valve 119 of each cylinder is located at a center of an area defined by the pair of suction valves 164 and the pair of exhaust valves 165 corresponding to the fuel injection valve 119. The fuel injection valve 119 is held and secured by a valve holding body 170 from above the fuel injection valve 119. The valve holding body 170 is bolt jointed to the upper surface of the cylinder head 72. The end portion of the valve holding body 170 opposite the fuel injection valve 119 is supported by a bearing block 171 from below the valve holding body 170. The bearing block 171 pivotally supports the valve gear shaft 168. The valve holding body 170 is located between the valve arm 167 for the suction valve 164 and the valve arm 167 for the exhaust valve 165 of each cylinder.

The fuel injection valve 119 of each cylinder is coupled with a fuel pipe 172 through which high-pressure fuel is supplied from the outside is coupled. The fuel pipe 172 penetrates through the side wall of the lower cover body 161 at the mounting side of the suction manifold 73 to communicate with each fuel injection valve 119. The fuel pipe 172 according to this embodiment includes: a high-pressure sealing member 173 that penetrates through the side wall of the lower cover body 161 at the mounting side of the suction manifold 73; and a fuel injection pipe 126 that couples the high-pressure sealing member 173 and the common rail 120. The high-pressure sealing member 173 has its distal end portion (the end portion protruding into the lower cover body 161) engaged with a receiving nozzle portion 174 that protrudes from an intermediate portion of the fuel injection valve 119. The high-pressure sealing member 173 is tightly inserted into and secured at the penetrating portion of the side wall of the lower cover body 161 at the mounting side of the suction manifold 73, thus securely sealing the penetrating portion. The fuel injection valves 119 of the cylinders are coupled to each other through a valve-fuel return pipe 175 so that the fuel injection valves 119 return an excess of fuel to the fuel tank 118 through the valve-fuel return pipe 175.

In the head cover 160, an injector harness 176 to supply electric power to the injection valves 119 is disposed on the opposite side, in a plan view, of the fuel pipes 172 across the fuel injection valves 119. From the intermediate portion and one end side of the injector harness 176, branch harnesses 177 extend toward the respective fuel injection valves 119. Each branch harness 177 has, at its distal end side, a pair of positive and negative terminals 178. The terminals 178 are coupled to respective terminal portions 179 disposed on the upper end side of each fuel injection valve 119 corresponding to the terminals 178.

The other end side of the injector harness 176 is coupled to a relay connector 180 at the interior of the lower cover body 161. The relay connector 180 penetrates through the side wall of the lower cover body 161 at the mounting side of the suction manifold 73. The relay connector 180 relays supply of electric power to the fuel injection valves 119 from outside the head cover 160. The relay connector 180 according to this embodiment is tightly inserted into and secured at the penetrating portion of the side wall of the lower cover body 161 at the mounting side of the suction manifold 73 adjacent to the cooling fan 76, thus securely sealing the penetrating portion. The injector harness 176 according to this embodiment extends from the relay connector 180, circumvents a fuel injection valve 119 among the fuel injection valves 119 that is adjacent to the cooling fan 76, and extends along the valve gear shaft 168. Accordingly, in the head cover 160, the fuel injection valves 119 (injectors 115), the injector harness 176, and the relay connector 180 form a unit.

The relay connector 180 has an outer end that protrudes outward through the lower cover body 161. An outer harness coupled to a controller is detachably coupled to the outer end of the relay connector 180. This eliminates the need for drawing the other end side of the injector harness 176 to outside the head cover 160, and ensures a complete wiring structure for the fuel injection valves 119 within the head cover 160. Electric power (control signal) transmitted from the controller travels through the outer harness, the relay connector 180, and the injector harness 176, and is fed to the fuel injection valves 119. Thus, the fuel injection valves 119 are electronically controlled (fuel injection and ignition are carried out on an individual cylinder basis).

On the inner side of the lower cover body 161, a harness guide 181 extending along the valve gear shaft 168 (in the direction of the crankshaft 74 of the diesel engine 70) is mounted on the opposite side, in a plan view, of the fuel pipe 172 across the fuel injection valves 119. The harness guide 181 according to this embodiment includes a plurality of downwardly extending branched legs 182. On the side wall of the lower cover body 161 at the mounting side of the suction manifold 73, a plurality of inwardly protruding reinforcing ribs 183 are formed. The lower end portion of each of the branched legs 182 is screwed to the upper end surface of a corresponding one of the reinforcing ribs 183. The intermediate portion of the injector harness 176 extends along the horizontally long portion of the harness guide 181 and is secured thereto by, for example, a coupling band (not shown).

The vertical length of each of the branched legs 182 is lengthened such that the horizontally long portion of the harness guide 181 is above the valve holding body 170. This makes the injector harness 176 upwardly apart from the valve gear mechanism 163, thereby eliminating the possibility of the injector harness 176 interfering with the behavior of the valve gear mechanism 163. Further, as detailed in FIG. 15, the lower cover body 161 has, at its side wall, an upper peripheral portion 161*a* positioned at a height that is the same as or lower than the top of the valve arm 167 or the valve bridge 169 constituting the valve gear mechanism 163. In other words, the vertical height H of the side wall of the lower cover body 161 is set at a level at which the top of the valve arm 167 or the valve bridge 169 is exposed in a side view when the upper cover body 162 is removed.

This ensures that removing the upper covet body 162 to open the upper portion of the head cover 160 (valve arm chamber) exposes the valve arm 167 and the valve bridge 169 in an easily touchable (easily adjustable) state. This facilitates the maintenance work of the valve arm 167 and the valve bridge 169 such as clearance adjustment. In this case, the lower cover body 161 need not be removed from the cylinder head 72, which eliminates the need for drawing the fuel pipe 172 (the high-pressure sealing member 173 and a fuel injection pipe 126) out of the receiving nozzle portion 174 of each fuel injection valve 119. Similarly, the injector harness 176 and the relay connector 180 need not be removed. Accordingly, the sealing conditions of the portions through which the high-pressure sealing member 173 and the relay connector 180 penetrate remain unchanged even though the upper cover body 162 is detached and attached. This results in a simple sealing structure necessary to ensure sealability (air tightness and oil tightness) of the head cover 160. Additionally, during detachment and attachment of the upper cover body 162, it is not necessary to remove the fuel pipe 172 and the injector harness 176, thereby significantly improving workability.

Thus, this configuration provides a structure of the head cover 160 of the engine 70. The head cover 160 covers the upper part of the cylinder head 72 to accommodate the valve gear mechanism 163 and the injector 115. The head cover 160 is separatable into the lower cover body 161 and the upper cover body 162 detachable from and attachable to the lower cover body 161. The lower cover body 161 includes the fuel pipe 172, through which fuel is supplied to the injector 115 and which penetrates through the lower cover body 161, and the relay connector 180, which relays power supply from outside the head cover 160 and is attached to the lower cover body 161. One end side of the injector harness 176 disposed in the head cover 160 is coupled to the terminal portion of the injector 115. Another end side of the injector harness 176 is coupled to the relay connector 180. This ensures detachment and attachment of the upper cover body 162 without removing the injector harness 176 and the relay connector 180, as well as the fuel pipe 172 as described above. This provides the advantageous effect of significantly improving the workability of the opening and closing work of the head cover 160 and maintenance work of the interior of the head cover 160. Additionally, the sealing conditions of the portions through which the fuel pipe 172 (the high-pressure sealing member 173) and the relay connector 180 penetrate remain unchanged even though the upper cover body 162 is detached and attached. This results in an advantageously simple sealing structure necessary to ensure sealability (air tightness and oil tightness) of the head cover 160.

Furthermore, the upper peripheral portion 161*a* of the lower cover body 161 is positioned at a height that is the same as or lower than the top of the valve arm 167 or the valve bridge 169 constituting the valve gear mechanism 163. This ensures that removing the upper cover body 162 to open the upper portion of the head cover 160 (valve arm chamber) exposes the valve arm 167 and the valve bridge 169 in an easily touchable (easily adjustable) state. This facilitates the maintenance work of the valve arm 167 and the valve bridge 169 such as clearance adjustment, providing the advantageous effect of further improving maintenance performance of the interior of the head cover 160.

Additionally, in the head cover 160, the harness guide 181 is disposed above the valve gear mechanism 163. The harness guide 181 extends in the direction of the crankshaft 74 of the engine 70. The intermediate portion of the injector harness 176 is mounted and secured on the harness guide 181. Due to the existence of the harness guide 181, the wiring pathway of the injector harness 176 is easily recognizable. This provides the advantageous effect of improving workability of assembly of the injector harness 176. Additionally, since the injector harness 176 is disposed on the harness guide 181 disposed above the valve gear mechanism 163, the injector harness 176 is upwardly apart from the valve gear mechanism 163. This advantageously minimises the possibility of the injector harness 176 interfering with the behavior of the valve gear mechanism 163.

(5) Structure of Diesel Engine Mounted to Tractor

Next, by referring to FIGS. 16 and 17, description will be given with regard to a structure in which the diesel engine 70 shown in FIGS. 1 to 15 is mounted on a tractor 201. The tractor 201 serves as an operation unit and has a travelling body 202 supported by a lateral pair of front wheels 203 and a lateral pair of rear wheels 204. The front wheels 203 and the rear wheels 204 are driven by the diesel engine 70 mounted on the front portion of the travelling body 202 to implement forward or reverse travel.

The engine 70 is covered by a hood 206. On the upper surface of the travelling body 202, a cabin 207 is mounted. In the cabin 207, a control seat 208 is disposed for an operator to sit on. In front of the control seat 208, a control handle 209 in the form of a round handle is disposed as steering means. The operator sitting on the control seat 208 operatively turns the control handle 209 to change the handling angle (steering angle) of the right and left front wheels 203 in accordance with the amount of manipulation (amount of turning operation). On the bottom of the cabin 207, steps 210 are disposed for the operator to ascend.

Figure 16:
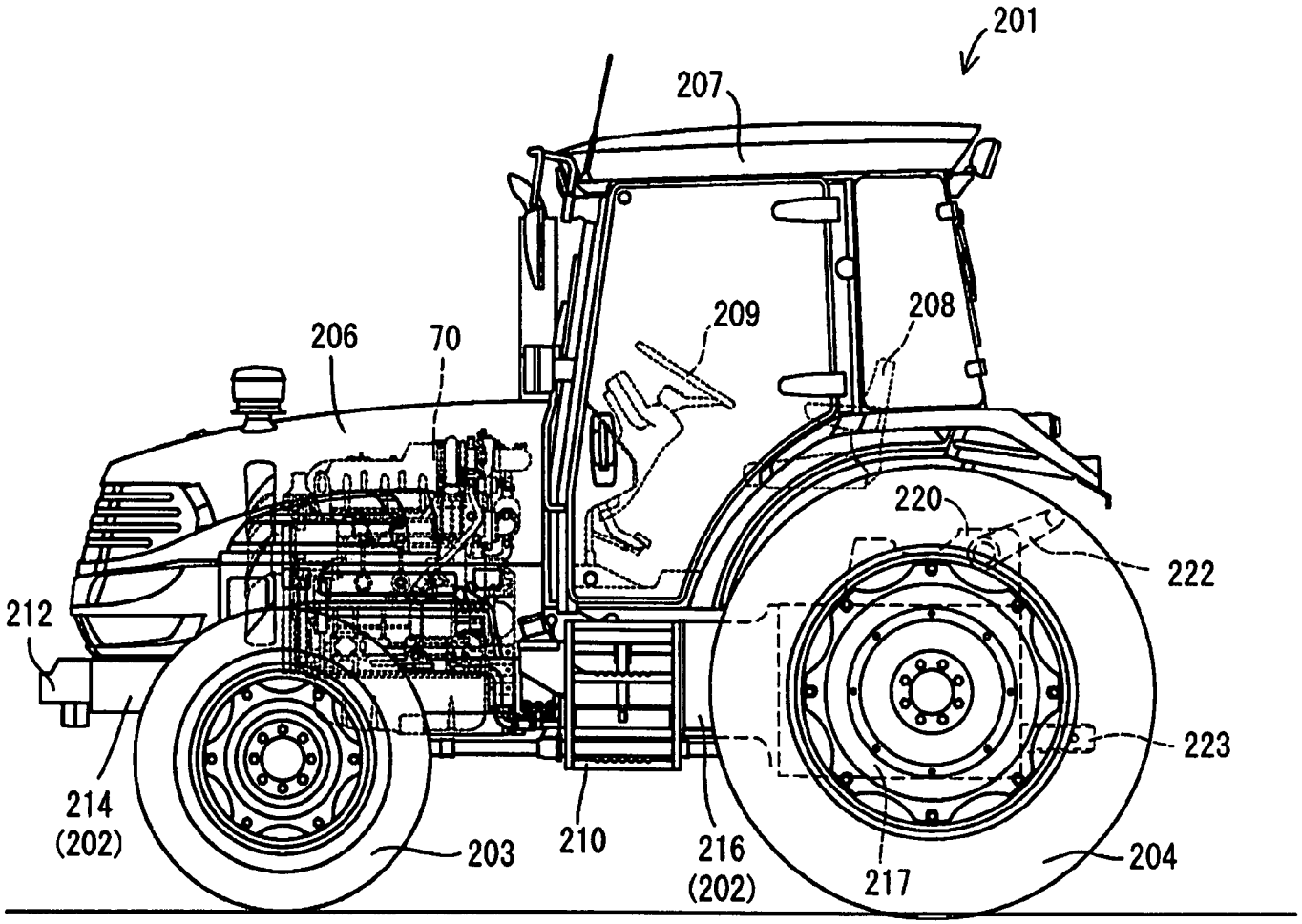
FIG. 16 is a side view of a tractor.
Figure 17:
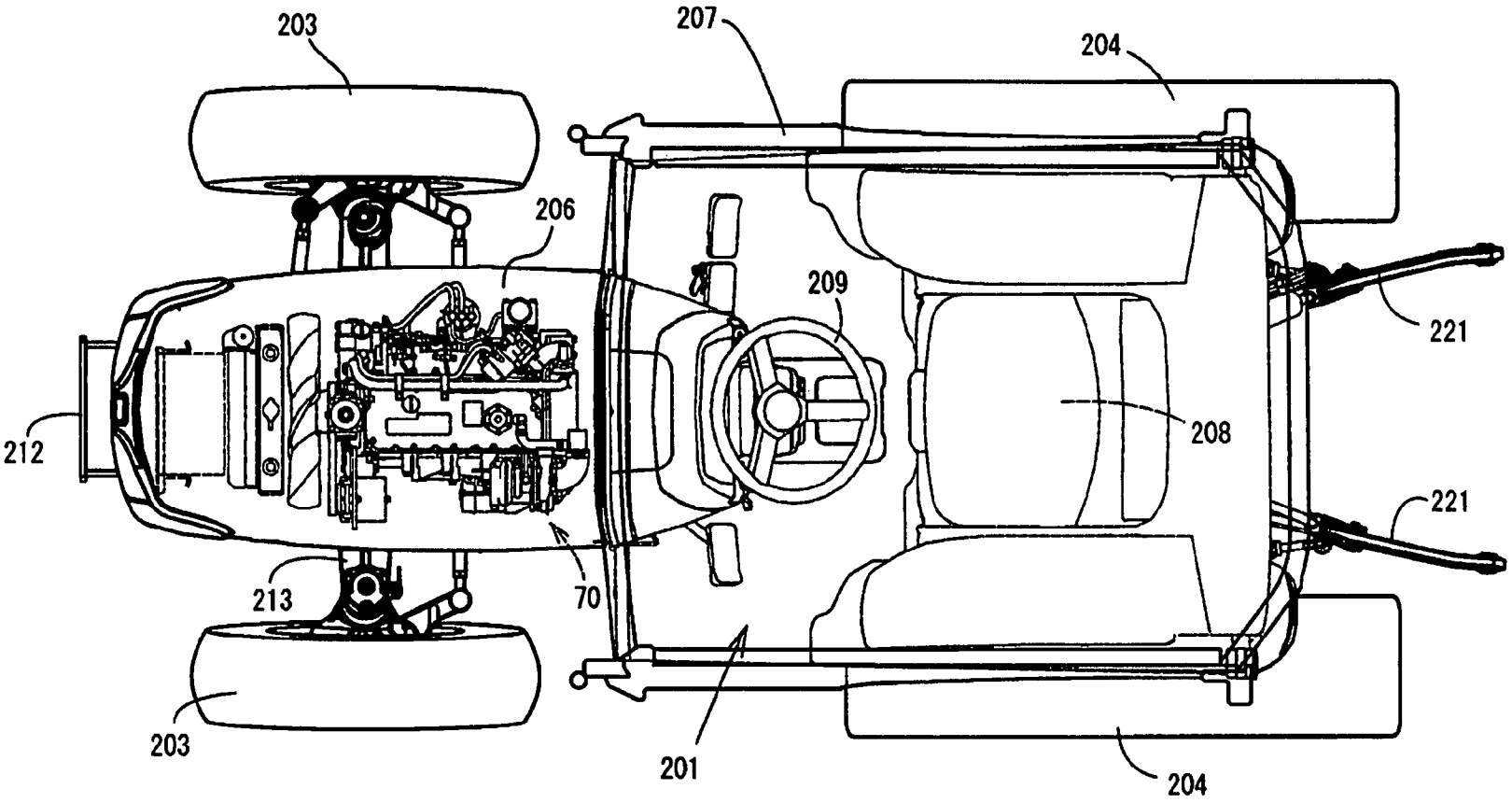
FIG. 17 is a plan view of the tractor.

As shown in FIG. 16, the travelling body 202 includes: an engine frame 214 including a front bumper 212 and a front axle case 213; and right and left vehicle body frames 216 detachably and attachably coupled to the rear portion of the engine frame 214 by bolt-joint. The front wheels 203 are attached to the travelling body 202 through the front axle case 213, which protrudes outward from the outside surface of the engine frame 214. To the rear portion of each of the vehicle body frames 216, a transmission case 217 is coupled so as to suitably change the output power of the diesel engine 70 and to transmit the changed output power to the rear wheel 204 (the front wheel 203). Each rear wheel 204 is attached to the corresponding transmission case 217 through a rear axle case (not shown) that protrudes outward from an outside surface of the transmission case 217.

As shown in FIG. 16, on the rear upper surface of the transmission case 217, an operation-unit hydraulic elevating mechanism 220 is detachably and attachably mounted to move up and down an operation unit (not shown) such as a cultivator. The operation unit such as a cultivator is coupled to the rear portion of the transmission case 217 through a lower link 221 and a top link 222 to ensure upward and downward movement. On the rear surface of the transmission case 217, a PTO shaft 223 through which to drive the operation unit is disposed.

The rotative power of the diesel engine 70 is transmitted from the rear surface side thereof to the front surface side of each transmission case 217 through the crankshaft 74, the flywheel 79, and other components, which is not detailed in the drawings. The rotative power of the diesel engine 70 is transmitted to the transmission case 217. Then at the diesel engine 70, the rotative power of the diesel engine 70 is suitably shifted in terms of speed by a hydraulic, continuously variable transmission and a travelling sub-transmission gear mechanism. The transmission case 217 transmits the driving power to the corresponding rear wheel 204 through a differential gear mechanism and other components. The rotation of the diesel engine 70 is shifted in terms of speed by the travelling sub-transmission gear mechanism, and transmitted from the transmission case 217 to the corresponding front wheel 203 through a differential gear mechanism and other components of the front wheels 203.

(6) Structure with the Diesel Engine Mounted on Common Combine Harvester

Figure 18:
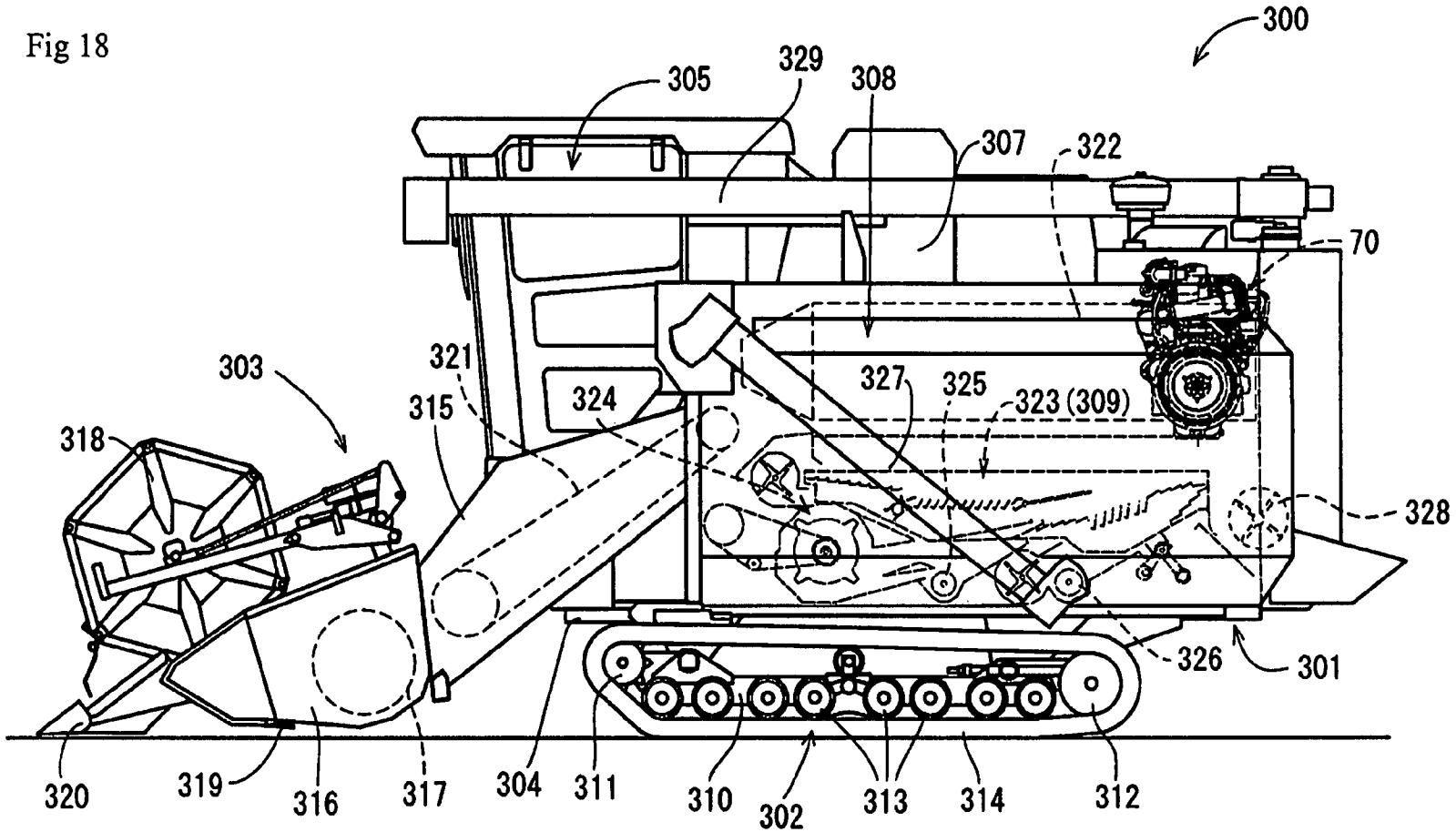
FIG. 18 is a side view of an common combine harvester.
Figure 19:
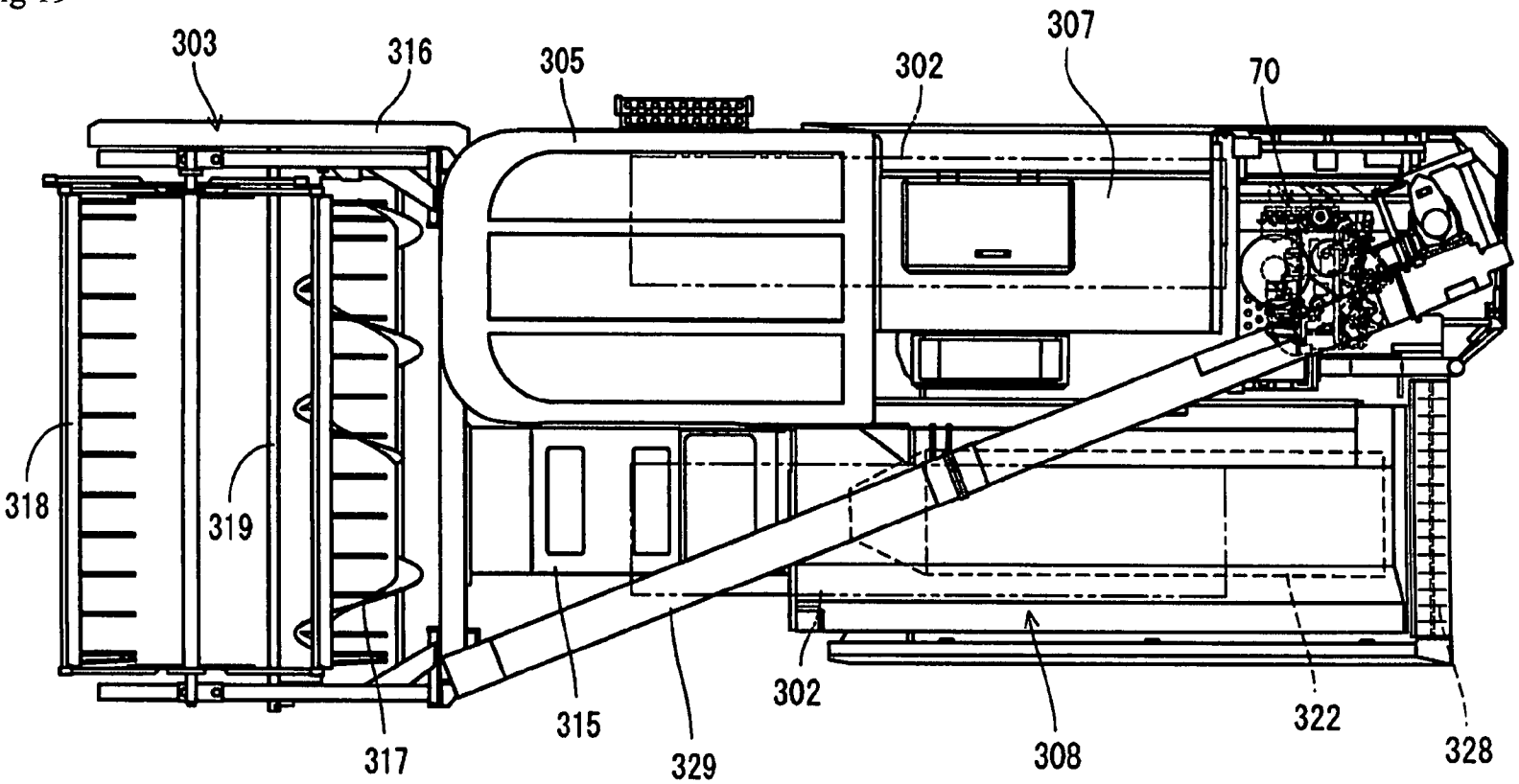
FIG. 19 is a plan view of the common combine harvester.

By referring to FIGS. 18 and 19, description will be given with regard to a structure in which the diesel engine 70 shown in FIGS. 1 to 15 is mounted on a common combine harvester 300. The common combine harvester 300 serves as an operation unit and includes a travelling body 301 supported by a lateral pair of travelling crawlers 302 that serve as travelling sections. On the front portion of the travelling body 301, a reaper 303 is elevatably mounted with a single-acting hydraulic cylinder 304. The reaper 303 simultaneously reaps and brings in planted standing grain culms such as of rice, wheat, and soy.

On one front side (the right front side in this embodiment) of the travelling body 301, an operation section 305 of cabin type is mounted. The travelling body 301 incorporates, in its rear portion, a grain tank 307 that stores threshed grains, and the diesel engine 70 serving as a power source. On the other side of the travelling body 301 (the left side in this embodiment), a threshing device 308 is mounted to thresh reaped grain culms fed from the reaper 303. Below the threshing device 308, a sorting device 309 is disposed to carry out rocking sorting and wind sorting.

The right and left travelling crawlers 302 serving as travelling sections include: drive wheels 311 and idler wheels 312 respectively disposed at the front and rear ends of a track frame 310 that is disposed below the travelling body 301 and elongated in the anteroposter direction; a plurality of rolling wheels 313 disposed along the longitudinal intermediate portion of the track frame 310; and belts 314 looped over the peripheries of the wheels 311 to 313. The right and left driving wheels 311 are driven into rotation by the power from a drive output shaft that protrudes outwardly in the right and left directions from a transmission case (not shown). This drives the right and left crawler belts 314 into rotation over the wheels 311 to 313.

The reaper 303 includes: a feeder house 315 that is in the form of a rectangular cylinder and communicates with a front opening of the threshing device 308; and a platform 316 that is in the form of a horizontally long bucket and continues to the front end of the feeder house 315. The lower surface portion of the feeder house 315 and the front end portion of the travelling body 301 are coupled to one another through the single-acting hydraulic cylinder 304. In the platform 316, a transverse-feed auger 317 is pivotally supported. Above the front portion of the transverse-feed auger 317, a scraping reel 318 with a tine bar is disposed. On the lower surface side of the platform 316, reaping blades 319 in the form of laterally long hair clippers are disposed. On the front portion of the platform 316, a lateral pair of grass dividers 320 are provided in a protruding manner. The scraping reel 318 pulls down planted standing grain culms in the backward direction, and the reaping blade 319 reaps the grain culms. The reaped culms are collected approximately at the center of the platform 316 in the lateral direction by the rotation driving of the transverse-feed auger 317. The collected culms are fed in the threshing device 308 through a chain conveyer 321 disposed in the feeder house 315.

The threshing device 308 has a threshing chamber that internally includes a threshing drum 322 that is elongated in the anteroposter direction and threshes the reaped planted grain culms. On the peripheral surface of the threshing drum 322, screw blades with a plurality of cutting teeth are spirally wound in a protruding manner. The reaped planted grain culms conveyed into the threshing chamber are finely cut with the cutting teeth of the threshing drum 322.

A sorting device 309 is disposed below the threshing device 308 and includes: a rocking sorting device 323 including a receiving net and a chaff sieve; and a wind sorting device 324 including a winnower fan. Grains leaked downward from the receiving net are sorted into first grains such as clean grains, second grains such as grains with tailings, waste culms (straw dust), and the like by the rocking sorting device 323 and the wind sorting device 324. By the sorting with the rocking sorting device 323 and the wind sorting device 324, the first grains are collected in a first grain receiving trough located at a lower portion of the travelling body 301. The first grains are then accumulated into the grain tank 307 through a first grain conveyer 325 and a grain lifting conveyer (not shown). The second grains such as grains with tailings are returned to the threshing chamber through a second grain conveyer 326, a reduction conveyer 327, and the like to be rethreshed in the threshing drum 322. The rethreshed second grains are re-sorted by the sorting device 309. Straw dusts are finely cut by a spreader 328 disposed below the rear portion of the threshing device 308, and discharged in the backward direction of the travelling body 301. The grains in the grain tank 307 are transferred to a carrier of a transportation truck or the like (transferred outside the travelling body 301) through a discharge auger 329 disposed upright on the rear portion of the travelling body 301.

DESCRIPTION OF REFERENCE NUMERAL

70 Diesel engine
72 Cylinder head
73 Suction manifold
74 Crankshaft
75 Cylinder block
115 Injector
120 Common nail
160 Head cover
161 Lower cover body
161*a* Upper peripheral portion
162 Upper cover body
163 Valve gear mechanism
167 Valve arm
168 Valve arm shaft
169 Valve bridge
172 Fuel pipe
173 High-pressure sealing member
174 Receiving nozzle portion
175 Valve fuel returning pipe
176 Injector harness
179 Terminal portion (on the valve side)
180 Relay connector

The invention claimed is:

1. An engine comprising a head cover covering an upper part of a cylinder head to accommodate a valve gear mechanism and an injector, wherein the head cover is separable into a lower cover body and an upper cover body detachable from and attachable to the lower cover body, the lower cover body comprising:

a fuel pipe through which fuel is supplied to the injector, the fuel pipe penetrating through the lower cover body; and a relay connector configured to relay power supply from outside the head cover, the relay connector being attached to the lower cover body;

wherein one end side of an injector harness disposed in the head cover is coupled to a terminal portion of the injector, and another end side of the injector harness is coupled to the relay connector; and wherein the lower cover body has an uppermost peripheral portion positioned at a height that is same as or lower than a top of a valve arm or a valve bridge constituting the valve gear mechanism.

2. The engine according to claim 1, further comprising a harness guide in the head cover, the harness guide extending in a direction of a crankshaft of the engine and being disposed above the valve gear mechanism, wherein the injector harness has an intermediate portion mounted and secured on the harness guide.

3. The engine according to claim 1 further comprising:

crank angle detecting means for detecting a crank angle of a crankshaft;

rotation angle detecting means for detecting a rotation angle of a rotation shaft configured to rotate in conjunction with the crankshaft, wherein the engine is configured to carry out fuel injection and ignition on an individual cylinder basis based on detection information from the crank angle detecting means and the rotation angle detecting means, wherein the rotation shaft comprises a pump shaft at a fuel supply pump disposed adjacent to a suction manifold, wherein a pump shaft pulser is disposed on the pump shaft, and wherein the rotation angle detecting means is disposed on a peripheral side of the pump shaft pulser.

4. The engine according to claim 3, wherein a gear case is disposed at one side portion of a cylinder block, the gear case accommodating a crank gear on the crankshaft, a pump gear on the pump shaft, and an idle gear engaged with the crank gear and the pump gear, and wherein the pump shaft pulser is integrally rotatably mounted on the pump gear in the gear case.

5. The engine according to claim 4, wherein the gear case comprises an insertion portion in which the rotation angle detecting means is mounted to oppose to the pump shaft pulser.

6. The engine according to claim 3, wherein a flywheel rotating integrally with the crankshaft is disposed at another side portion of the cylinder block, and wherein a crankshaft pulser corresponding to the crank angle detecting means and a starter ring gear are engaged and secured to a peripheral side of the flywheel from mutually opposite sides along a thickness direction of the flywheel.

7. The engine according to claim 1, further comprising a harness guide in the head cover, the harness guide extending in a direction of a crankshaft of the engine and being disposed above the valve gear mechanism, wherein the injector harness has an intermediate portion mounted and secured on the harness guide.

8. The engine according to claim 1, further comprising:

crank angle detecting means for detecting a crank angle of a crankshaft;

rotation angle detecting means for detecting a rotation angle of a rotation shaft configured to rotate in conjunction with the crankshaft, wherein the engine is configured to carry out fuel injection and ignition on an individual cylinder basis based on detection information from the crank angle detecting means and the rotation angle detecting means, wherein the rotation shaft comprises a pump shaft at a fuel supply pump disposed adjacent to a suction manifold, wherein a pump shaft pulser is disposed on the pump shaft, and wherein the rotation angle detecting means is disposed on a peripheral side of the pump shaft pulser.

9. The engine according to claim 2, further comprising:

crank angle detecting means for detecting a crank angle of a crankshaft;

rotation angle detecting means for detecting a rotation angle of a rotation shaft configured to rotate in conjunction with the crankshaft, wherein the engine is configured to carry out fuel injection and ignition on an individual cylinder basis based on detection information from the crank angle detecting means and the rotation angle detecting means, wherein the rotation shaft comprises a pump shaft at a fuel supply pump disposed adjacent to a suction manifold, wherein a pump shaft pulser is disposed on the pump shaft, and wherein the rotation angle detecting means is disposed on a peripheral side of the pump shaft pulser.

* * * * *